US007823659B2

(12) United States Patent
Costa et al.

(10) Patent No.: US 7,823,659 B2
(45) Date of Patent: Nov. 2, 2010

(54) APPARATUS AND METHODS FOR DRILLING AND LINING A WELLBORE

(75) Inventors: Darrell Scott Costa, Katy, TX (US); Kevin K. Waddell, Houston, TX (US); Edwin A. Zwald, Jr., Houston, TX (US); Charles Butterfield, Cypress, TX (US); Mark Holland, Katy, TX (US); Akindele Olufowoshe, Katy, TX (US); Gregory M. Noel, Katy, TX (US); Donald B. Campo, Richmond, TX (US)

(73) Assignee: Enventure Global Technology, LLC, Houston, TX (US)

( * ) Notice: Subject to any disclaimer, the term of this patent is extended or adjusted under 35 U.S.C. 154(b) by 165 days.

(21) Appl. No.: 12/170,880

(22) Filed: Jul. 10, 2008

(65) Prior Publication Data

US 2009/0014172 A1 Jan. 15, 2009

Related U.S. Application Data

(63) Continuation of application No. 11/838,782, filed on Aug. 14, 2007, now abandoned.

(60) Provisional application No. 60/948,890, filed on Jul. 10, 2007.

(51) Int. Cl.
*E21B 11/00* (2006.01)
*E21B 23/02* (2006.01)

(52) U.S. Cl. ..... 175/57; 175/171; 175/22; 175/98; 166/207

(58) Field of Classification Search ..... 175/57, 175/171, 22, 98, 230, 257, 263; 166/207
See application file for complete search history.

(56) References Cited

U.S. PATENT DOCUMENTS

| | | | | |
|---|---|---|---|---|
| 5,348,095 | A | 9/1994 | Worrall et al. | |
| 7,172,025 | B2 * | 2/2007 | Eckerlin | 166/380 |
| 2001/0002626 | A1 * | 6/2001 | Frank et al. | 175/57 |
| 2005/0056433 | A1 * | 3/2005 | Ring et al. | 166/384 |
| 2006/0196678 | A1 * | 9/2006 | Connell et al. | 166/380 |
| 2006/0260802 | A1 * | 11/2006 | Filippov et al. | 166/207 |

OTHER PUBLICATIONS

Examination Report for Canadian Application No. 2,597,909; Jul. 30, 2009; pp. 1-3.

* cited by examiner

*Primary Examiner*—Shane Bomar
*Assistant Examiner*—Brad Harcourt
(74) *Attorney, Agent, or Firm*—Derek V. Forinash

(57) ABSTRACT

A method of drilling and lining a wellbore includes operably coupling a support member to a drilling device, an expansion cone configured to expand a tubular member, an actuator configured to pull the expansion cone through the tubular member, a releasable locking device configured to limit displacement of the tubular member relative to the actuator during actuation. The drilling device is disposed below the expansion cone and the expansion cone is disposed at a lower end of the tubular member. The method further includes locking the locking device. After locking the locking device, a wellbore is drilled to have a diameter greater than an outside diameter of the tubular member. After the drilling, the actuator is actuated to pull the expansion cone towards the locking device to expand at least a portion of the tubular member into contact with the drilled wellbore. The method further includes releasing the locking device and removing the drilling device through the expanded tubular member.

7 Claims, 33 Drawing Sheets

APPARATUS AND METHODS FOR DRILLING AND LINING A WELLBORE

CROSS REFERENCE TO RELATED APPLICATIONS

This application is a continuation of U.S. application Ser. No. 11/838,782, filed Aug. 14, 2007, which claims priority to U.S. Provisional Application Ser. No. 60/948,890, filed Jul. 10, 2007, the disclosures of which are incorporated herein by reference in their entireties.

BACKGROUND OF THE INVENTION

This invention relates generally to oil and gas exploration, and in particular to forming and repairing wellbore casings to facilitate oil and gas exploration.

SUMMARY OF INVENTION

In one aspect, the present disclosure relates to an apparatus for radially expanding and plastically deforming a tubular member. The apparatus includes a support member, an expansion cone disposed at a lower end of the tubular member and configured to radially expand the tubular member, an actuator coupled to the support member and the expansion cone and configured to pull the expansion cone through at least a portion of the tubular member, a releasable locking device configured to limit displacement of the tubular member relative to the actuator during actuation, and a drilling device disposed below the expansion cone and having a drilling diameter greater than an outer diameter of the tubular member before expansion. The drilling device is in fluid communication with the support member.

In another aspect, the present disclosure relates to a method of drilling and lining a wellbore. The method includes operably coupling a support member to a drilling device, an expansion cone configured to expand a tubular member, an actuator configured to pull the expansion cone through the tubular member, a releasable locking device configured to limit displacement of the tubular member relative to the actuator during actuation. The drilling device is disposed below the expansion cone and the expansion cone is disposed at a lower end of the tubular member. The method further includes locking the locking device. After locking the locking device, a wellbore is drilled to have a diameter greater than an outside diameter of the tubular member. After the drilling, the actuator is actuated to pull the expansion cone towards the locking device to expand at least a portion of the tubular member into contact with the drilled wellbore. The method further includes releasing the locking device and removing the drilling device through the expanded tubular member.

Other aspects and advantages of the invention will be apparent from the following description and the appended claims.

BRIEF DESCRIPTION OF THE DRAWINGS

FIG. 7*ab* is a fragmentary cross-sectional illustration of an exemplary embodiment of the casing release of the expansion device assembly of FIG. 7*aa*.

DETAILED DESCRIPTION OF THE ILLUSTRATIVE EMBODIMENTS

Figure 1:
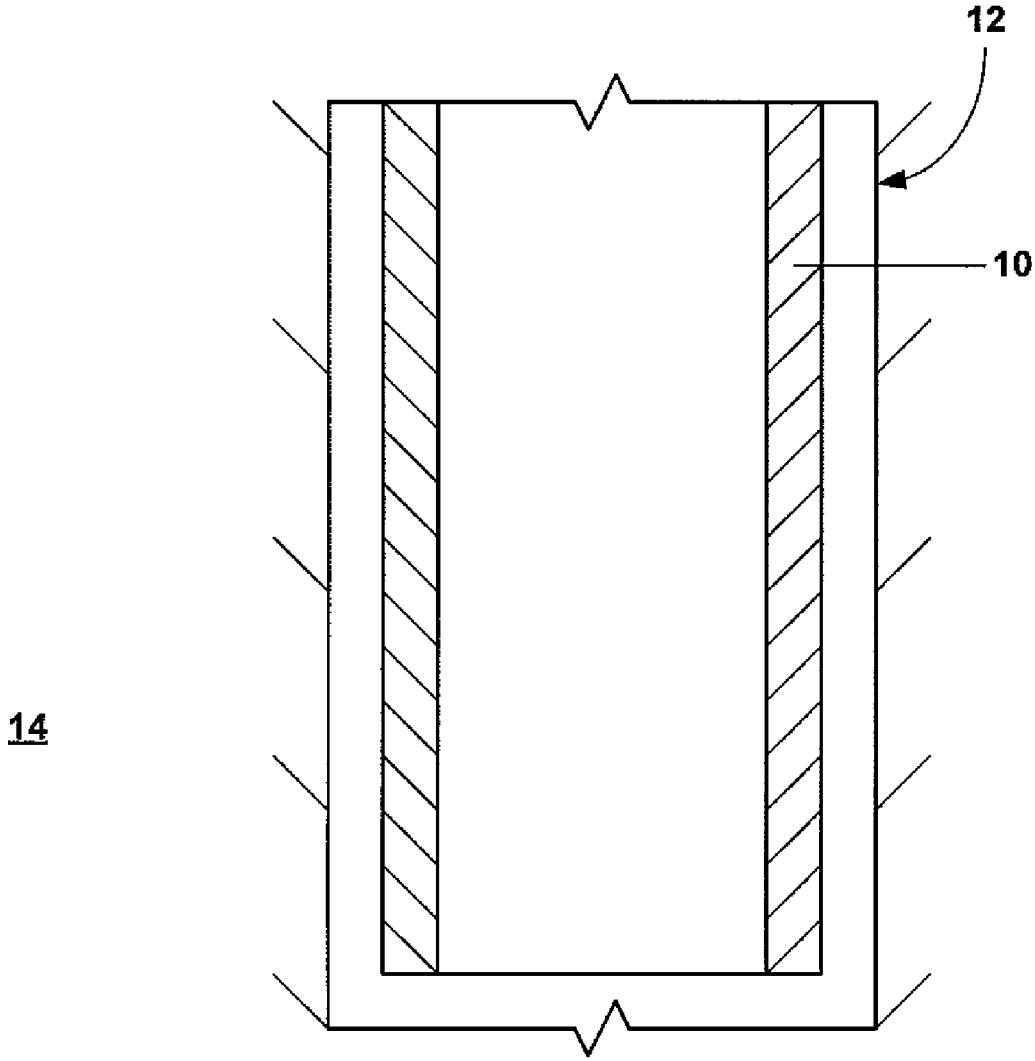
FIG. 1 is a fragmentary cross sectional view of an exemplary embodiment of an expandable tubular member positioned within a wellbore that traverses a subterranean formation.

Referring initially to FIG. 1, an expandable tubular member 10 is positioned within a wellbore 12 that traverses a subterranean formation 14.

Figure 2:
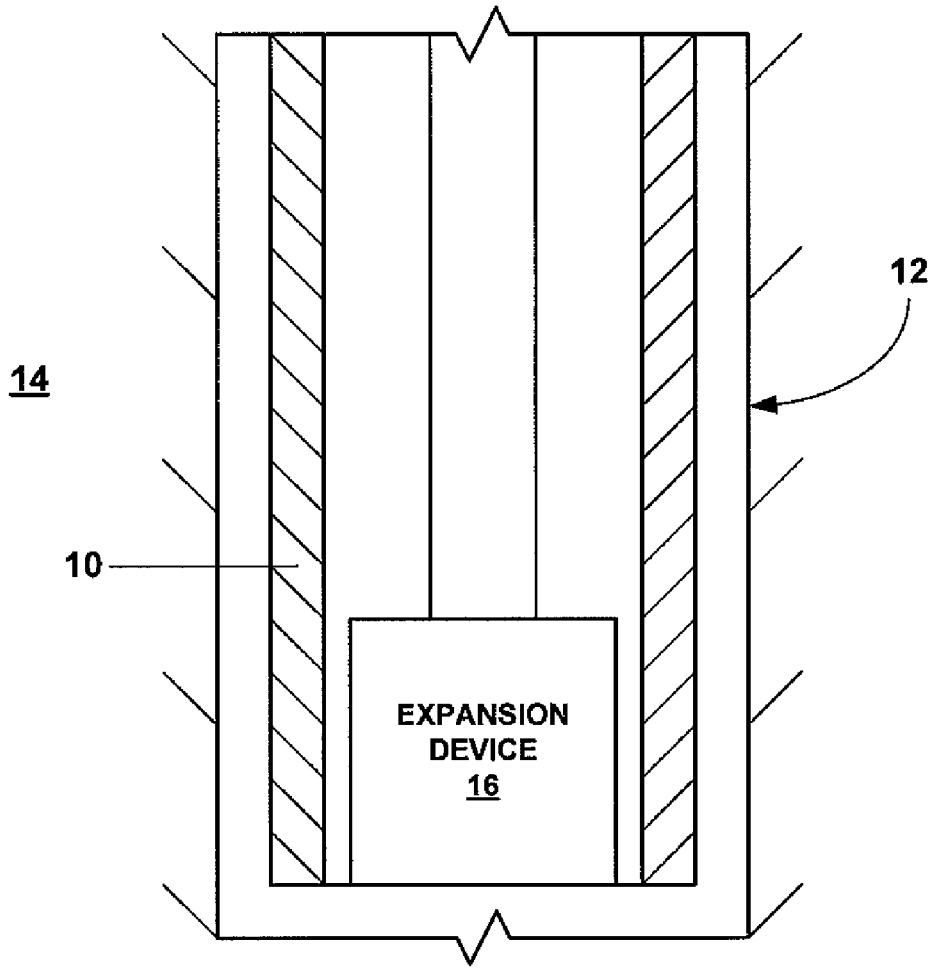
FIG. 2 is a fragmentary cross sectional view of the expandable tubular member of FIG. 1 after positioning an expansion device within the expandable tubular member.

As illustrated in FIG. 2, an expansion device 16 is then positioned within the tubular member 10. In several exemplary embodiments, the expansion device 16 may be positioned within the tubular member 10 before, during, or after the placement of the tubular member within the wellbore 12.

Figure 3:
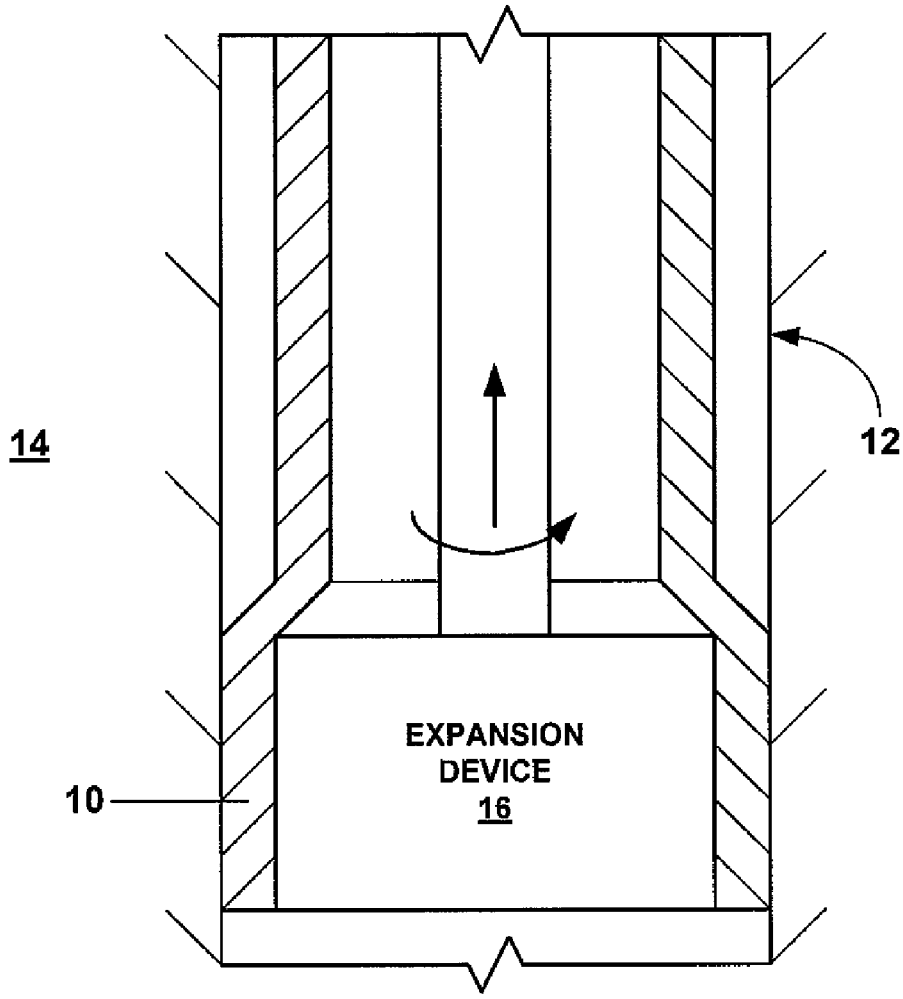
FIG. 3 is a fragmentary cross sectional view of the expandable tubular member of FIG. 2 after operating the expansion device within the expandable tubular member to radially expand and plastically deform at least a portion of the expandable tubular member into engagement with at least a portion of the interior surface of the wellbore.

As illustrated in FIG. 3, the expansion device 16 is then operated to radially expand and plastically deform at least a portion of the tubular member 10 into engagement with at least a portion of the interior surface of the wellbore 12.

Figure 4:
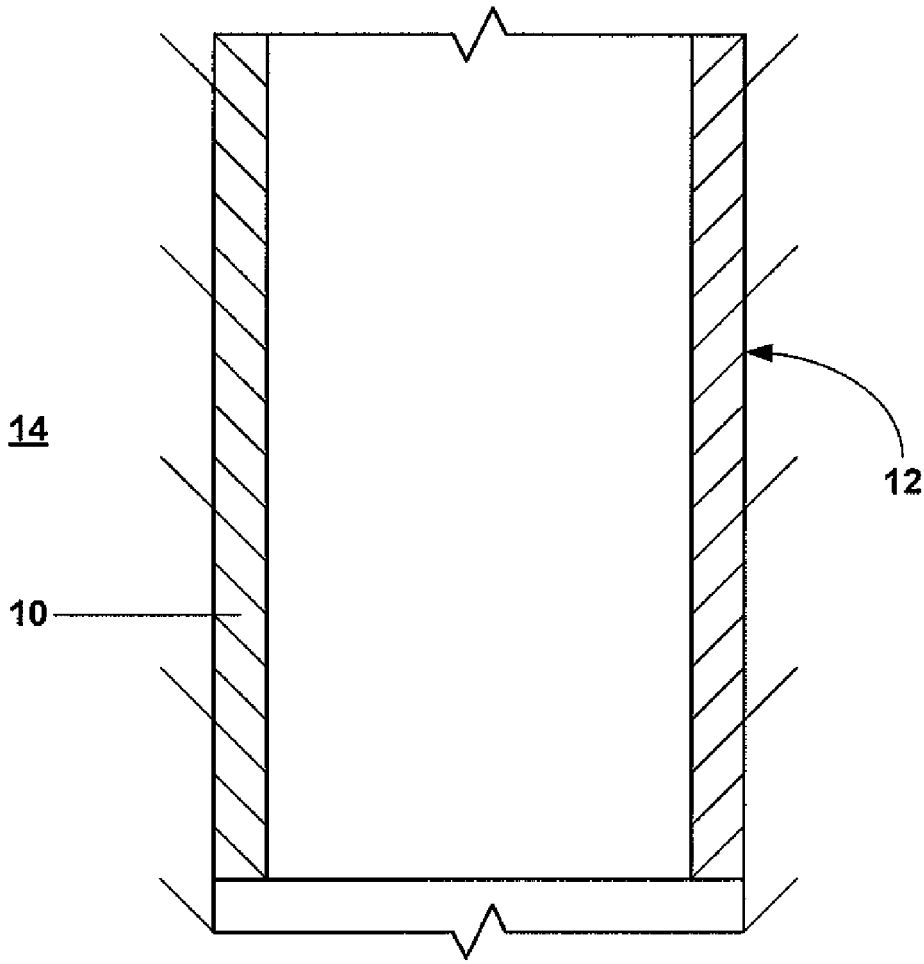
FIG. 4 is a fragmentary cross sectional view of the expandable tubular member of FIG. 3 after further operating the expansion device within the expandable tubular member to radially expand and plastically deform another portion of the expandable tubular member into engagement with at least another portion of the interior surface of the wellbore.

As illustrated in FIG. 4, the expansion device 16 is then further operated to radially expand the remaining portion of the tubular member 10 into engagement with first portions of the interior surface of the wellbore 12. In an exemplary embodiment, as a result of the operation of the In an exemplary embodiment, following the operation of the expansion device 16, the tubular member 10 remains in circumferential compression and the formation 14 surrounding the tubular member remains in circumferential tension. As a result, an interference fit is formed between the tubular member 10 and the surrounding formation 14.

In an exemplary experimental implementation, the wellbore casing 10 was radially expanded and plastically deformed into engagement with the interior surface of a wellbore 12 using a fluid powered expansion device 16. In the exemplary experimental implementation, the fluid powered expansion device 16 comprised a conventional solid expansion cone that was displaced upwardly through the casing 10 in a conventional manner using fluid pressure.

Figure 5:
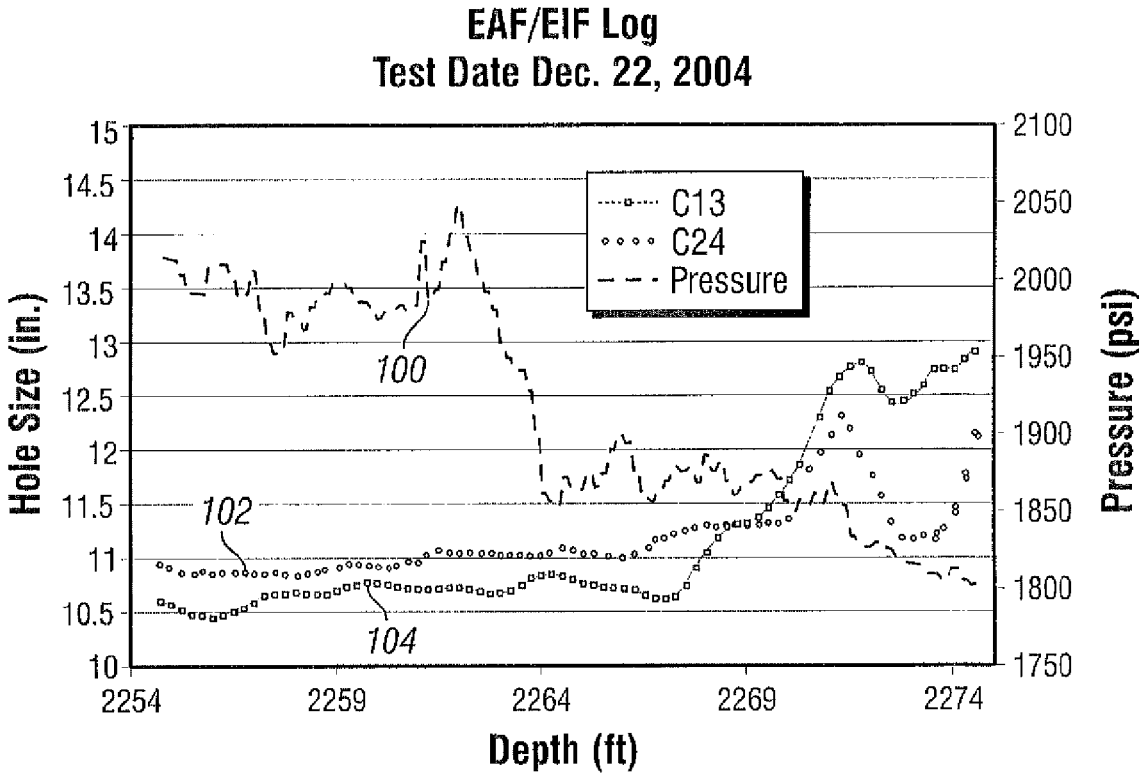
FIG. 5 is a graphical illustration of the operating pressure of the expansion device and the inside diameter of the wellbore during an exemplary experimental radial expansion and plastic deformation of the tubular member.

As illustrated in FIG. 5, during the exemplary experimental implementation, the operating pressure 100 of the expansion device 16, the inside diameter 102 of the wellbore 12 at one radial location proximate the expansion device, and the inside diameter 104 of the wellbore at another radial location proximate the expansion device were monitored in a conventional manner using conventional measuring devices.

As illustrated in FIG. 5, during the exemplary experimental implementation, the operating pressure 100 of the expansion device varied inversely with respect to the inside diameters, 102 and 104, of the wellbore 12. Thus, by monitoring the expansion forces required to radially expand and plastically deform the tubular member 10, the geometry of the wellbore 12 may be determined. Furthermore, by monitoring the expansion forces required to radially expand and plastically deform the tubular member 10, the material properties and geometry of the formation 14 may also be determined. For example, empirical data may be used to develop and generate a functional relationship between the expansion forces required to radially expand and plastically deform the tubular member 10 and the material properties and geometry of the formation 14. In this manner, by monitoring the expansion forces required to radially expand and plastically deform the tubular member 10, a log of the formation 14 may be generated.

Figure 6:
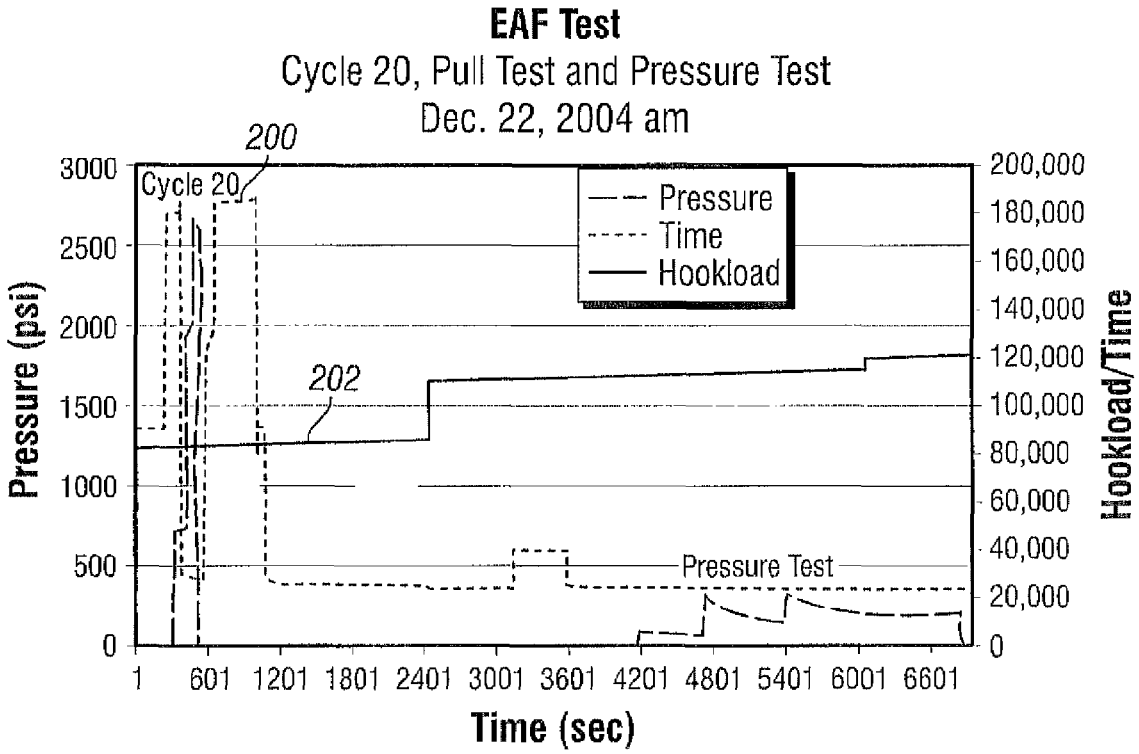
FIG. 6 is a graphical illustration of an exemplary experimental implementation of a pressure test and a pull test following an exemplary experimental radial expansion and plastic deformation of the tubular member.

As illustrated in FIG. 6, in an exemplary experimental implementation, following the completion of the radial expansion and plastic deformation of the tubular member 10, a pressure test was conducted to determine the degree to which a fluid tight metal to formation seal was created between the tubular member and the interior surface of the wellbore 12.

As illustrated in FIG. 6, the fluid tight metal to formation seal generated during the exemplary experimental implementation was capable of withstanding an operating pressure 200 of up to about 2700 psi.

As also illustrated in FIG. 6, in an exemplary experimental implementation, following the completion of the radial expansion and plastic deformation of the tubular member 10, a pull test was conducted to determine the degree to which a fluid tight metal to formation seal was created between the tubular member and the interior surface of the wellbore 12.

As illustrated in FIG. 6, the fluid tight metal to formation seal generated during the exemplary experimental implementation was capable of withstanding a tensile load 202 of about 120,000 lbf.

The experimental results, and observations derived therefrom, illustrated and described above with reference to FIGS. 5 and 6 were unexpected results.

Figure 7A:
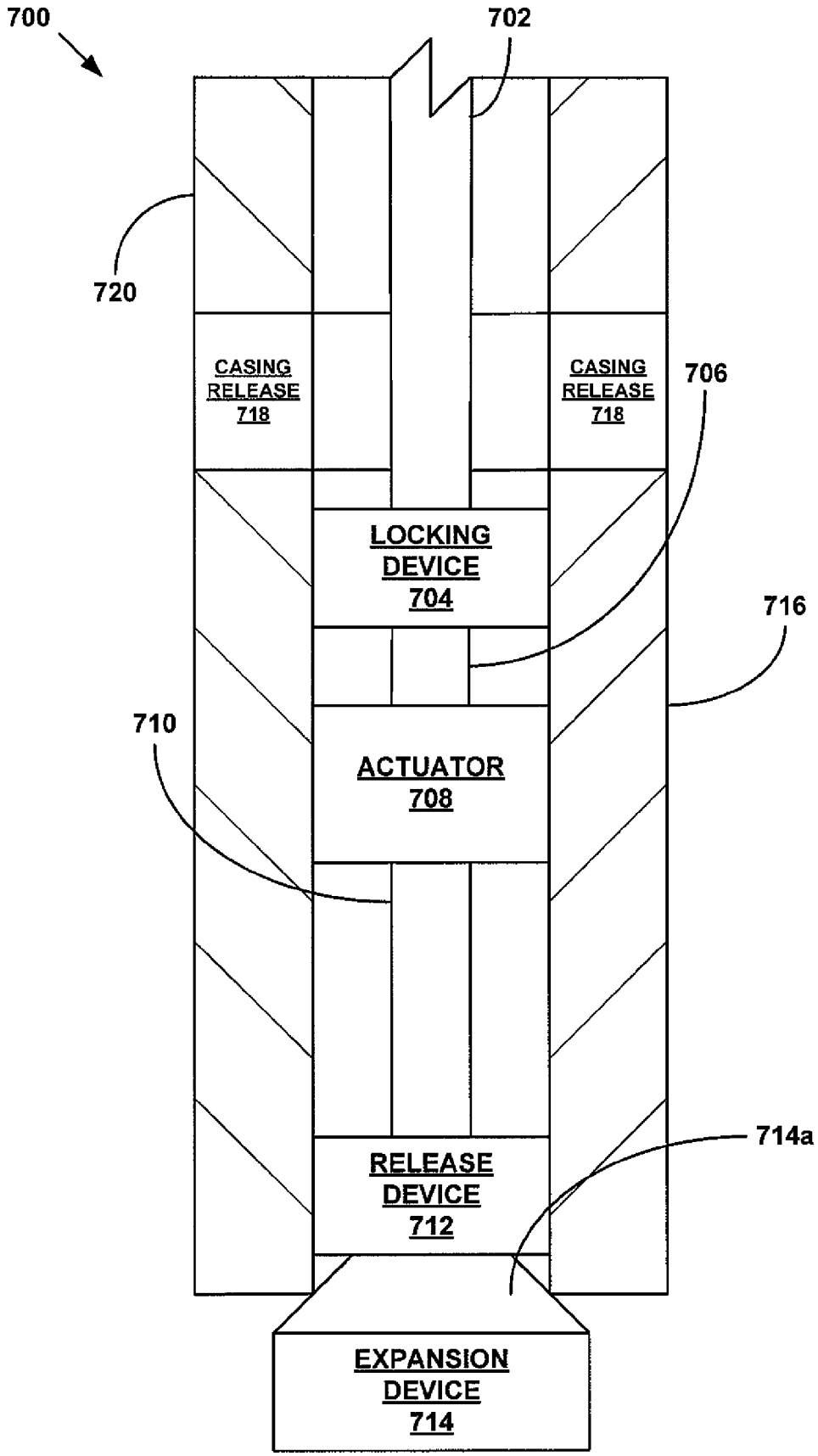
FIG. 7*aa* is a fragmentary cross sectional illustration of an exemplary embodiment of an expansion device assembly.
Figure 7A:
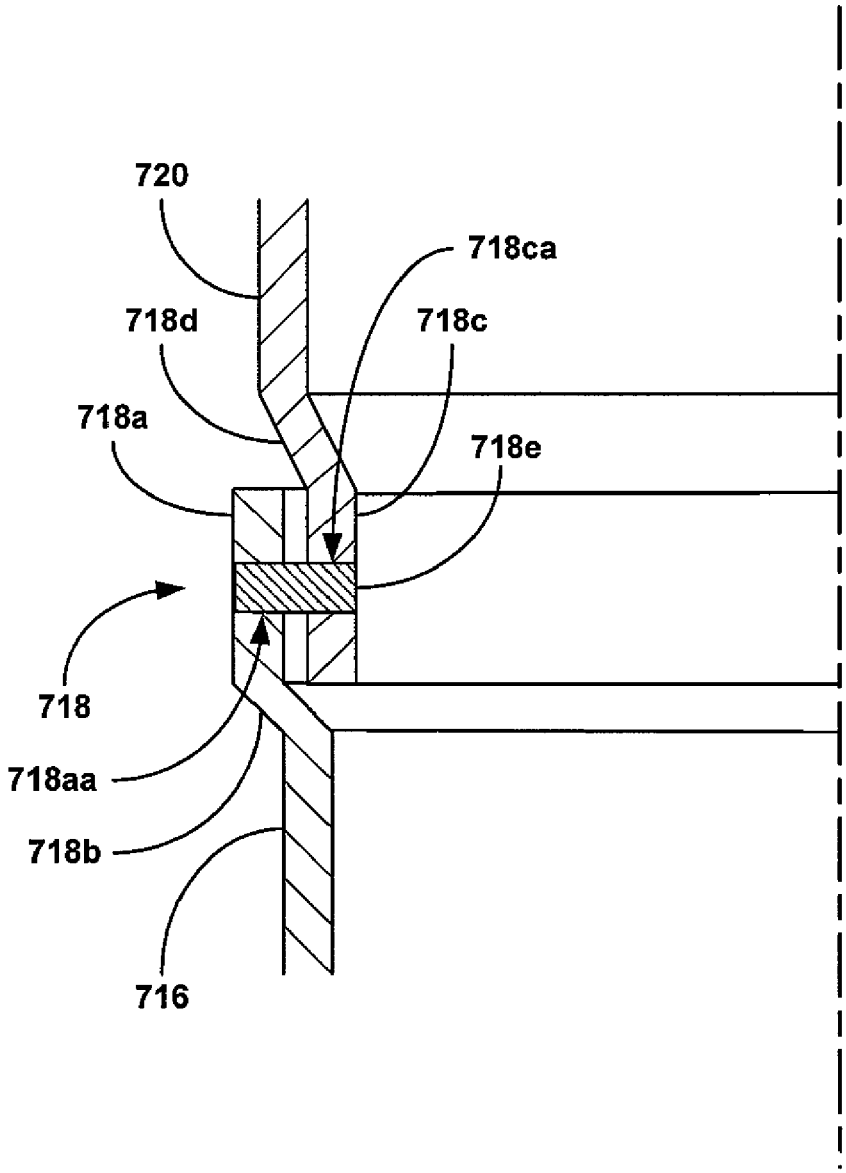

Referring now to FIGS. 7*aa* and 7*ab*, an exemplary embodiment of an expansion device assembly 700 includes a tubular support member 702 having an end that is coupled to an end of a locking device 704. In an exemplary embodiment, the tubular support member 702 is a conventional drill pipe and the locking device 704 is, for example, a conventional hydraulically actuated locking device suitable for locking onto a tubular member such as, for example, a wellbore casing.

Another end of the locking device 704 is coupled to an end of a tubular support member 706 and another end of the tubular support member is coupled to an end of an actuator 708. In an exemplary embodiment, the tubular support member 706 is a conventional drill pipe and the actuator 708 is a conventional actuator such as, for example, an hydraulic actuator suitable for displacing one or more elements relative to the actuator.

Another end of the actuator 708 is coupled to an end of a tubular support member 710 and another end of the tubular support member is coupled to an end of a release device 712. In an exemplary embodiment, the tubular support member 710 is a conventional drill pipe and the release device 712 is a conventional release device for controllably releasing one or more elements coupled to the release device such, for example, upon the application of a loading condition greater than or equal to a predetermined value.

An end of an expansion device 714 having one or more tapered expansion surfaces 714*a* is coupled to another end of the release device 712. In an exemplary embodiment, the expansion device 714 is a conventional expansion device.

An end of an expandable tubular member 716, that receives at least the actuator 708, the tubular support member 710, and the release device 712, is coupled to an supported by the tapered expansion surface 714*a* of the end of the expansion device 714. Another end of the expandable tubular member 716 is coupled to an end of a casing release 718 and another end of the casing release 718 is coupled to an end of an expandable tubular member 720. In an exemplary embodiment, the outside diameters of at least one of the expandable tubular member 716, the casing release 718, and/or the expandable tubular member 720 are greater than the outside diameter of the expansion device 714.

Referring now to FIG. 7*ab,* in an exemplary embodiment, the casing release 718 includes an outer tubular support member 718*a* that defines one or more radial passages 718*aa* having an end that is coupled to an end of a tapered tubular member 718*b.* Another end of the tapered tubular member 718*b* is coupled to an end of the tubular support member 716.

The casing release 718 further includes an inner tubular member 718*c* that defines one or more radial passages 718*ca* having an end that is coupled to an end of a tapered tubular member 718*d.* Another end of the tapered tubular member 718*b* is coupled to an end of the tubular support member 716.

In an exemplary embodiment, the diametrical clearance between the inner and outer tubular members, 718*a* and 718*c,* is a sliding fit.

The casing release further includes a conventional shear pin 718*e* having ends that mate with and are received within the passages, 718*aa* and 718*ca,* of the outer and inner tubular members, 718*a* and 718*c,* respectively.

In an exemplary embodiment, the casing release 718 is adapted to permit the application of radial expansion forces to the casing release without releasing the upper end of the expandable tubular member 716 from the lower end of the expandable tubular member 720 while permitting the upper end of the expandable tubular member 716 to be disengaged from the lower end of the expandable tubular member 720 if a predetermined toque loading is applied to the casing release.

Figure 7B:
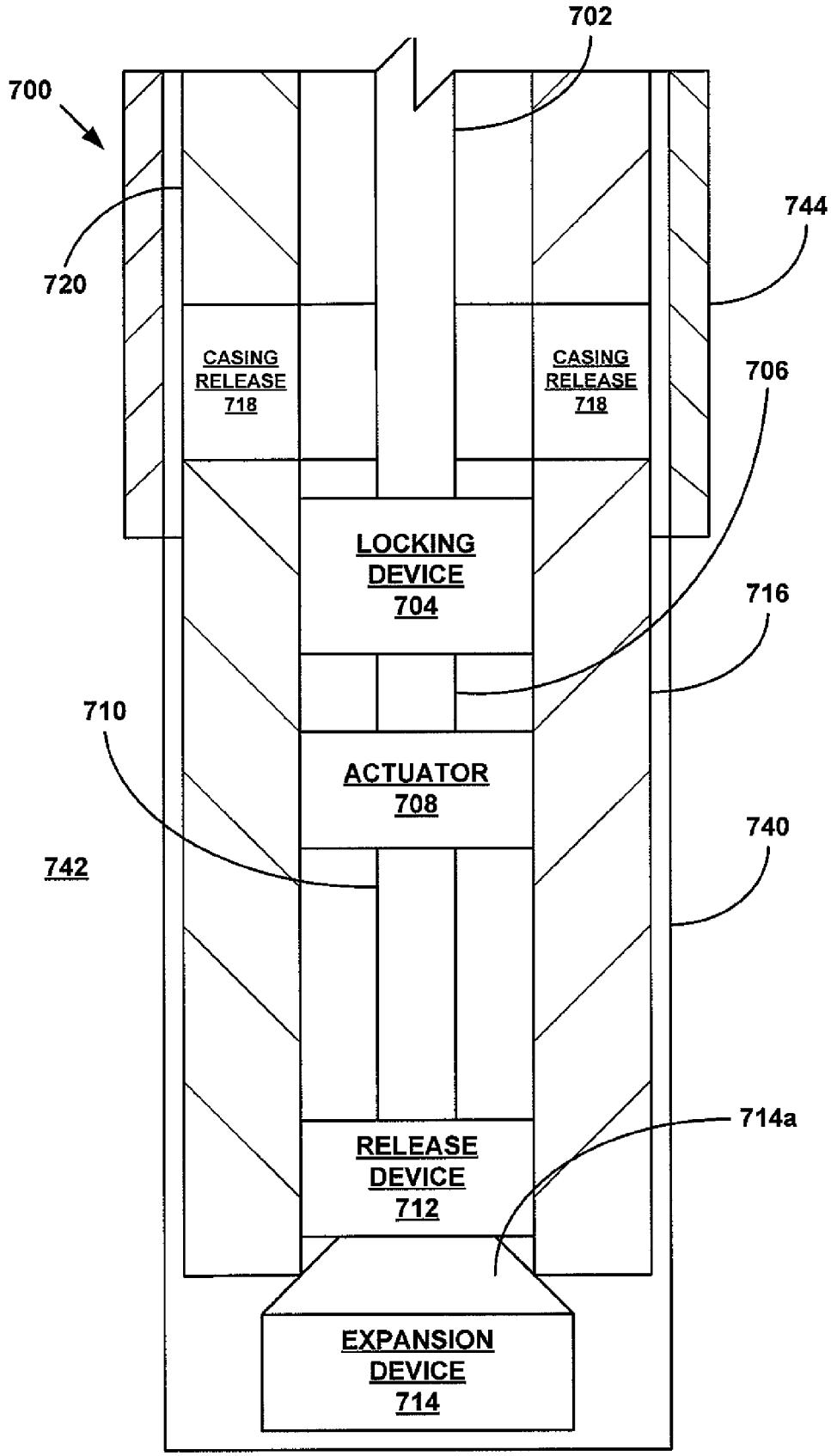
FIG. 7*b* is a fragmentary cross-sectional illustration of the placement of the expansion device assembly of FIG. 7*aa* within a wellbore that traverses a subterranean formation.

In several exemplary embodiments, the casing release 718 includes may include one or more of the following in addition to, or instead of, the structural features described above: 1) collets; 2) collets with a release sleeve; 3) a threaded connection that may be released by rotation; 4) splines to transfer torque; and/or 5) stress concentrations that permit release after radial expansion, and/or equivalents thereof Referring now to FIG. 7*b,* in an exemplary embodiment, during the operation of the expansion device assembly 700, the assembly is positioned within a wellbore 740 that traverses a subterranean formation 742. In an exemplary embodiment, at least a portion of the wellbore 740 includes a preexisting wellbore casing 744.

Figure 7C:
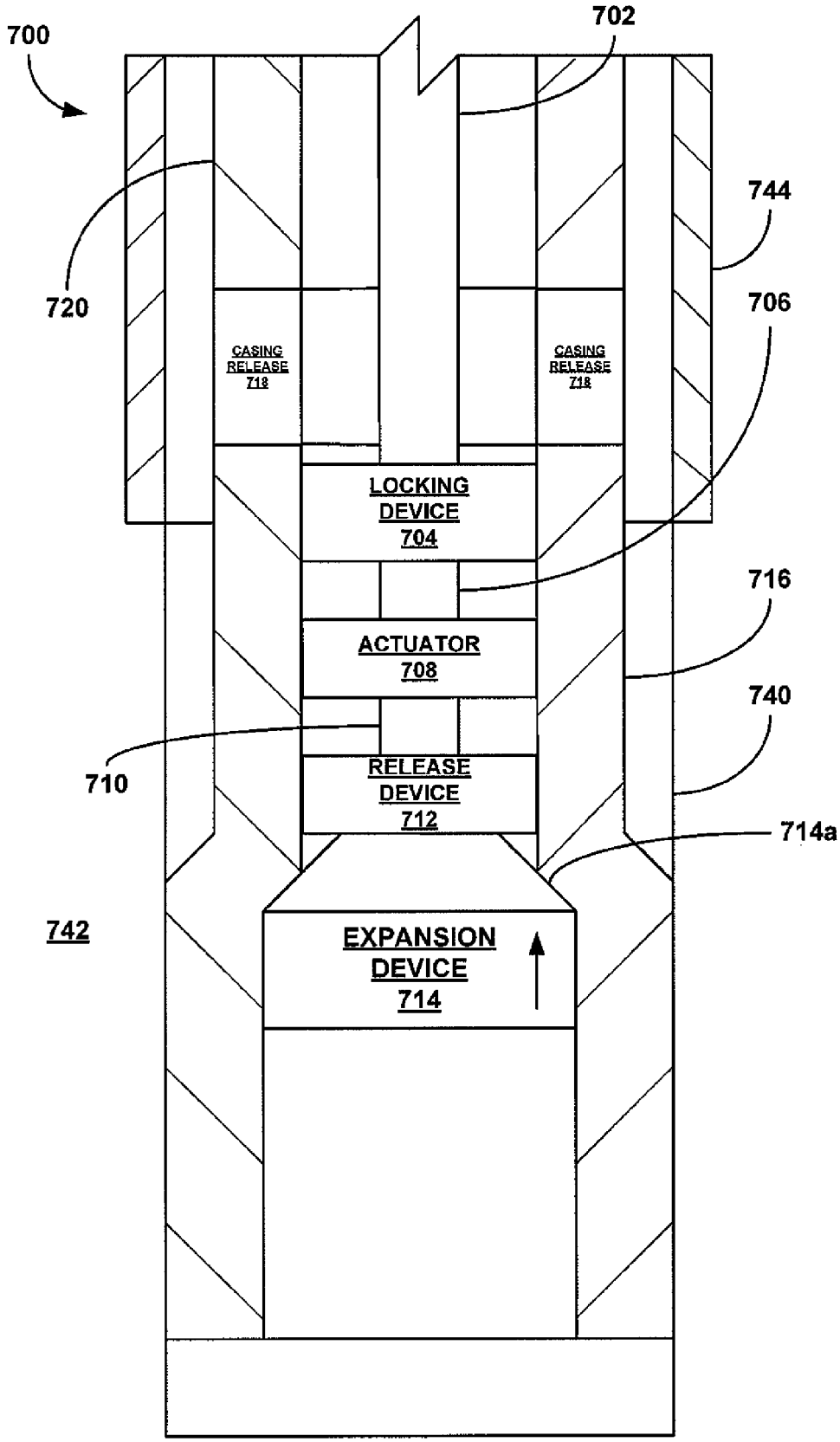
FIG. 7*c* is a fragmentary cross-sectional illustration of the operation of the expansion device assembly of FIG. 7*b* within the wellbore to radially expand and plastically deform a lower portion of a tubular member.

Referring now to FIG. 7*c,* in an exemplary embodiment, during the operation of the expansion device assembly 700, the locking device 704 is operated to engage and lock the position of the expandable tubular member 716 relative to the locking device. In an exemplary embodiment, the actuator 708 is then operated to displace the expansion device 714 upwardly relative to the locking device 704. As a result, the lower portion of the expandable tubular member 716 is thereby radially expanded and plastically deformed. Furthermore, in an exemplary embodiment, as a result, at least a portion of the expandable tubular member 716 is radially expanded and plastically deformed into engagement with the surrounding subterranean formation 742. Furthermore, in an exemplary embodiment, as a result, at least a portion of the surrounding subterranean formation 742 is elastically deformed following the radial expansion and plastic deformation of the lower portion of the expandable tubular member 716. In an exemplary embodiment, as a result, at least a portion of the lower portion of the expandable tubular member 716 is anchored to the surrounding subterranean formation 742.

Figure 7D:
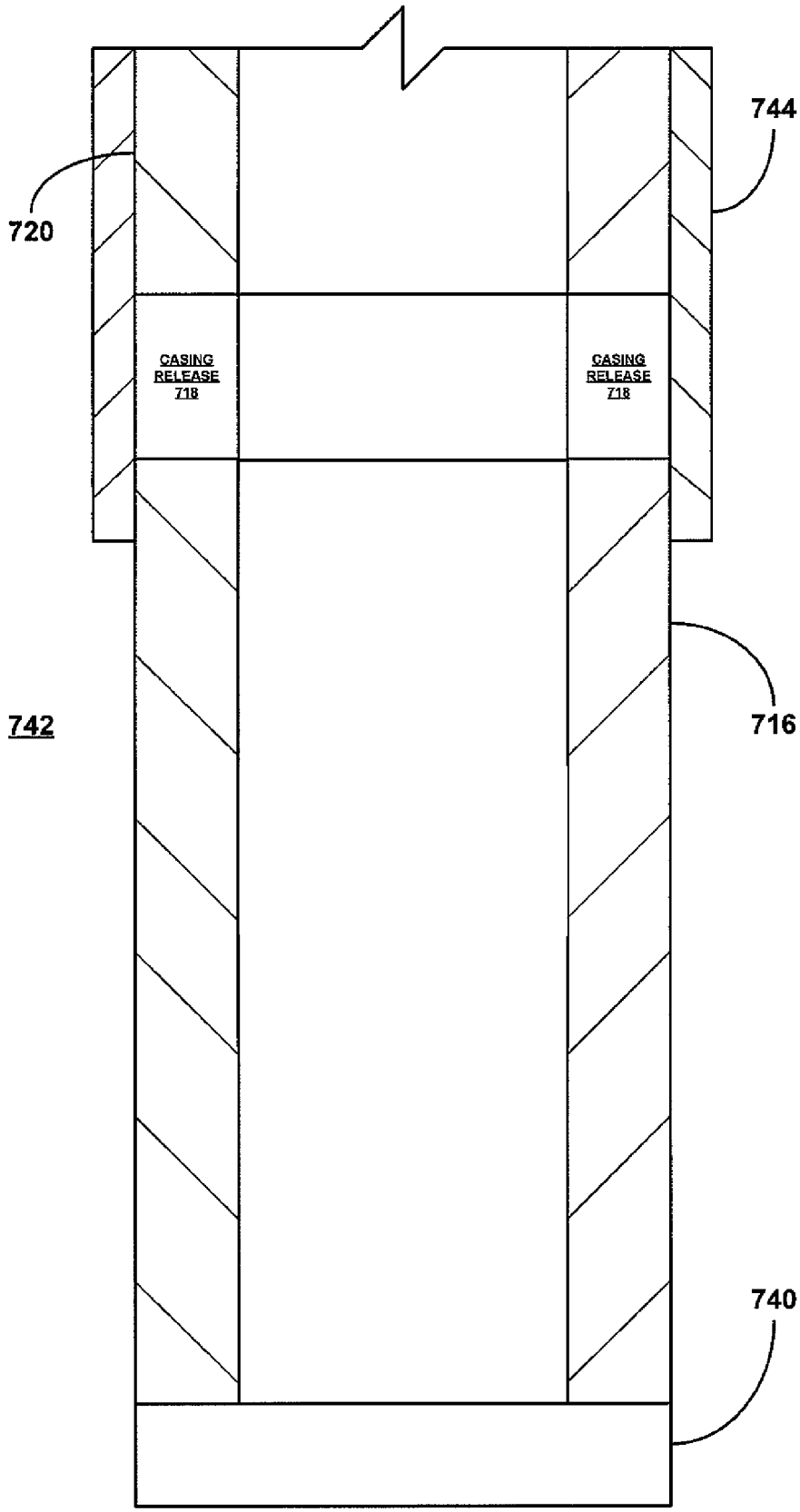
FIG. 7*d* is a fragmentary cross-sectional illustration of the further operation of the expansion device assembly of FIG. 7*c* within the wellbore to further radially expand and plasctically deform the tubular member.

Referring now to FIG. 7*d,* in an exemplary embodiment, the expansion device assembly 700 may be further operated to radially expand and plastically deform the remaining portion of the expandable tubular member 716, the casing release 718 and at least a portion of the expandable tubular member 720 by applying a upward tensile load on an end of the tubular support member 702.

In an alternative embodiment, the expansion assembly 700 may be further operated to radially expand and plastically deform the remaining portion of the expandable tubular member 716, the casing release 718 and at least a portion of the expandable tubular member 720 by resetting the actuator 708 and then re-stroking the actuator 708. In an alternative embodiment, during the re-stroking of the actuator 708, an upward tensile load may also be applied to the end of the tubular support member 702.

Figure 7E:
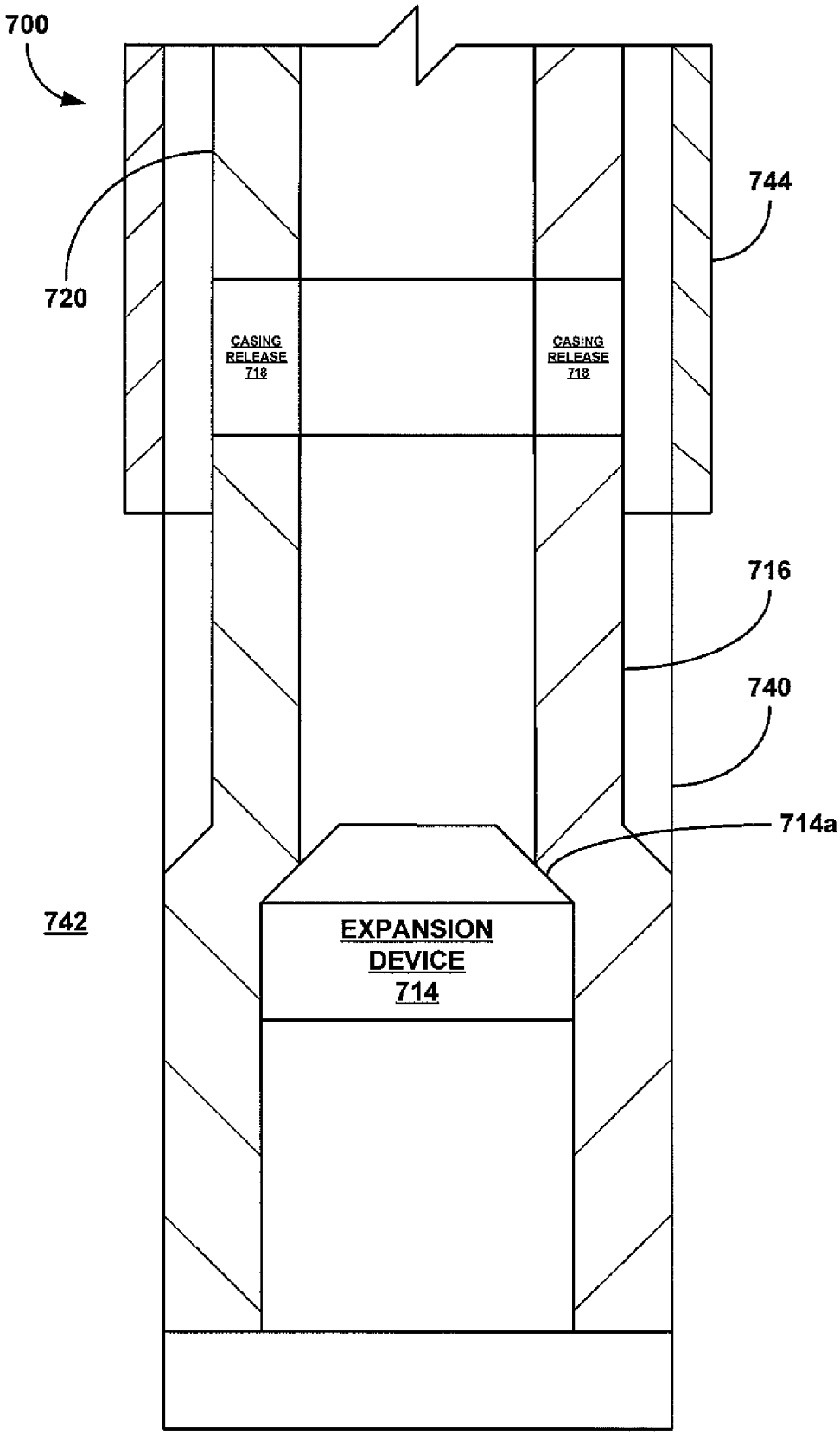
FIG. 7*e* is a fragmentary cross-sectional illustration of the further operation of the expansion device assembly of FIG. 7*c* within the wellbore in which the expansion cone is released by the release device.

Referring to FIG. 7*e,* in an exemplary embodiment, during operation of the expansion device assembly 700, the release device 712 may be operated to disengage the expansion device 714 from engagement with the release device by, for example, applying a predetermined torque loading to the release device. In this manner, the expansion device 714 may be released in the event of, for example, an unforeseen operating condition such as when the expansion device becomes stuck within the wellbore 740. The expansion device 714 may be then removed from the interior of the expandable tubular member 716 by, for example, drilling the expansion device out of the interior of the expandable tubular member.

Figure 7F:
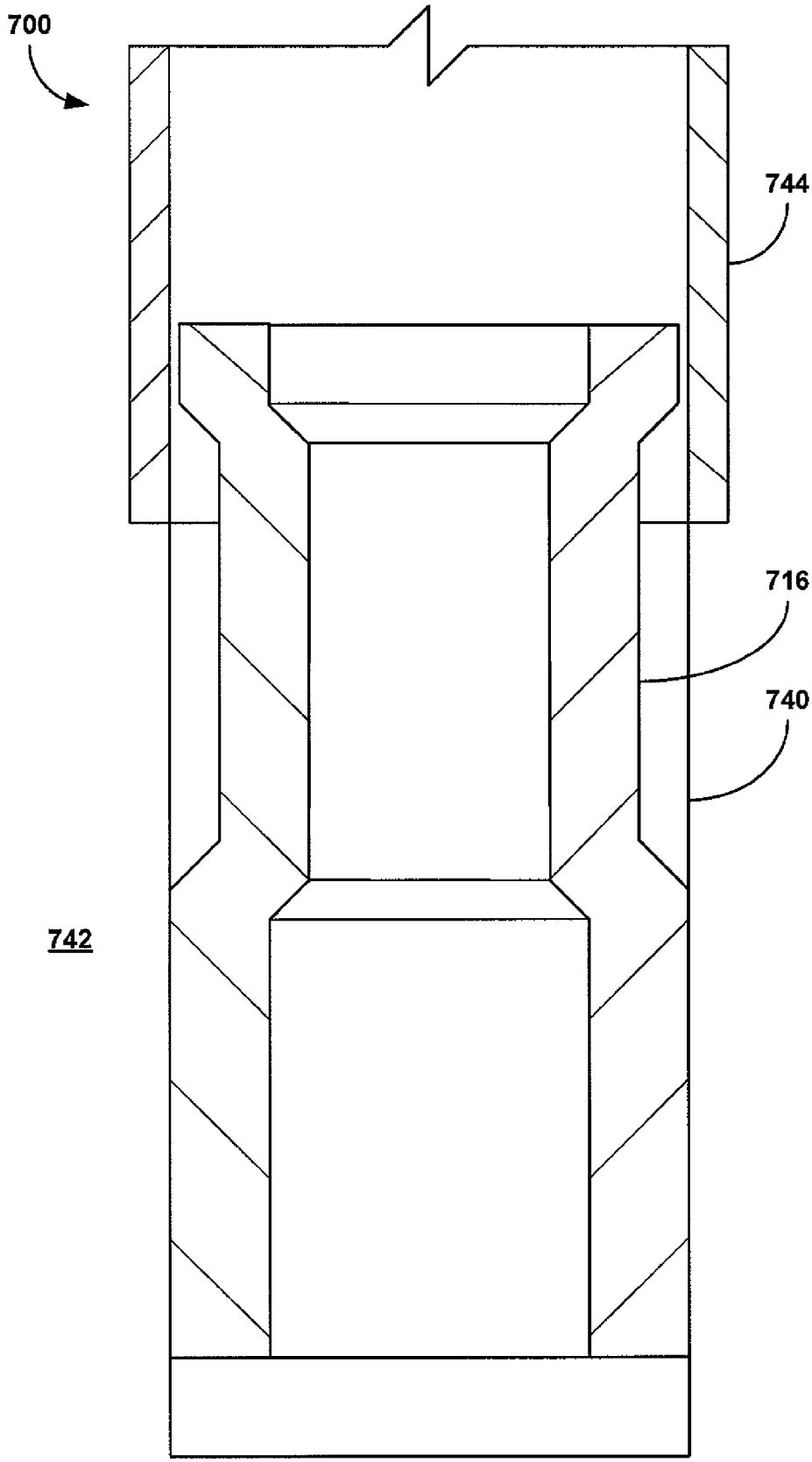
FIG. 7*f* is a fragmentary cross-sectional illustration of the further operation of the expansion device assembly of FIG. 7*e* within the wellbore in which the casing release is operated.

Referring to FIG. 7*f,* in an exemplary embodiment, during operation of the expansion device assembly 700, the casing release 718 may be operated to disengage the upper end of the expandable tubular member 716 from the lower end of the expandable tubular member 720 by, for example, applying a predetermined toque loading to the casing release 718. In this manner, the expandable tubular member 716 may be released from engagement with the expandable tubular member 720 without having to employ a casing cutter device.

Figure 8:
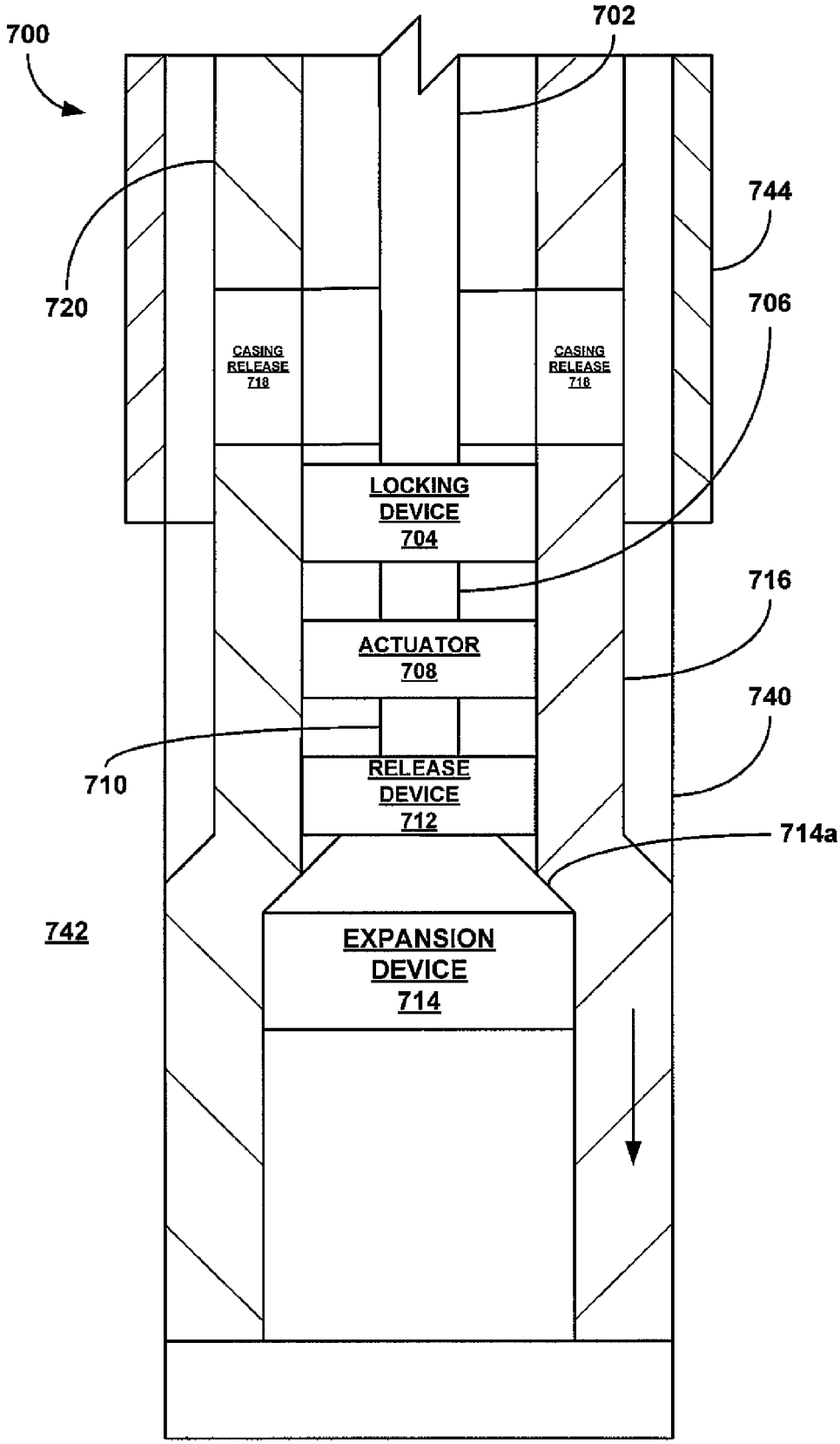
FIG. 8 is a fragmentary cross-sectional illustration of an alternative embodiment of the operation of the expansion device assembly of FIG. 7*b* within the wellbore to radially expand and plastically deform a lower portion of a tubular member.

Referring to FIG. 8, in an alternative embodiment, during the operation of the expansion device assembly 700, the locking device 704 is operated to engage and lock the position of the expandable tubular member 716 relative to the locking device. In an exemplary embodiment, the actuator 708 is then operated to displace the expandable tubular member 716 downwardly relative to the expansion device 714. As a result, the lower portion of the expandable tubular member 716 is thereby radially expanded and plastically deformed. Furthermore, in an exemplary embodiment, as a result, at least a portion of the expandable tubular member 716 is radially expanded and plastically deformed into engagement with the surrounding subterranean formation 742. Furthermore, in an exemplary embodiment, as a result, at least a portion of the surrounding subterranean formation 742 is elastically deformed following the radial expansion and plastic deformation of the lower portion of the expandable tubular member 716.

Figure 9A:
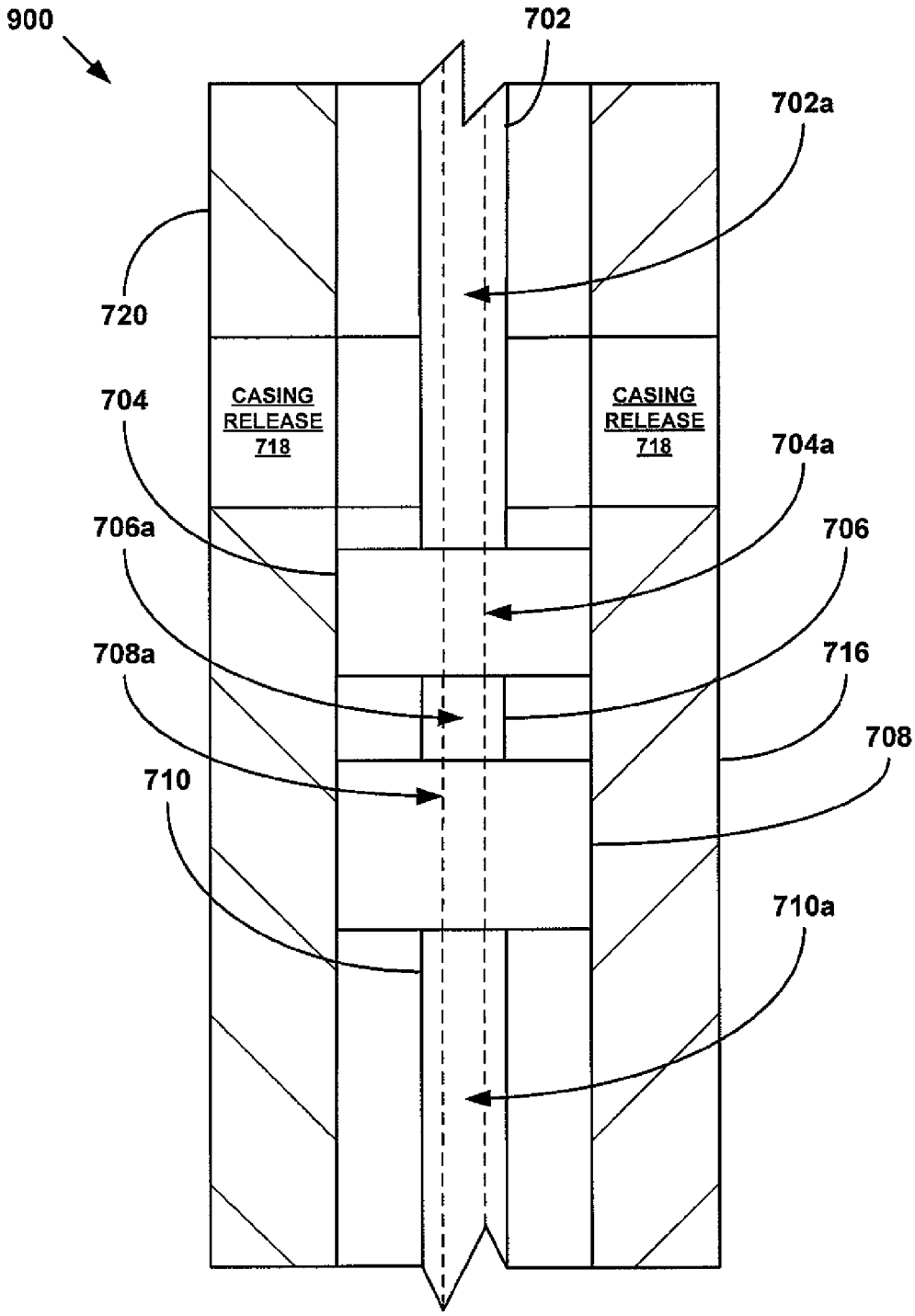
FIGS. 9*aa* and 9*ab* are fragmentary cross sectional illustrations of an exemplary embodiment of an expansion and drilling device assembly.
Figure 9A:
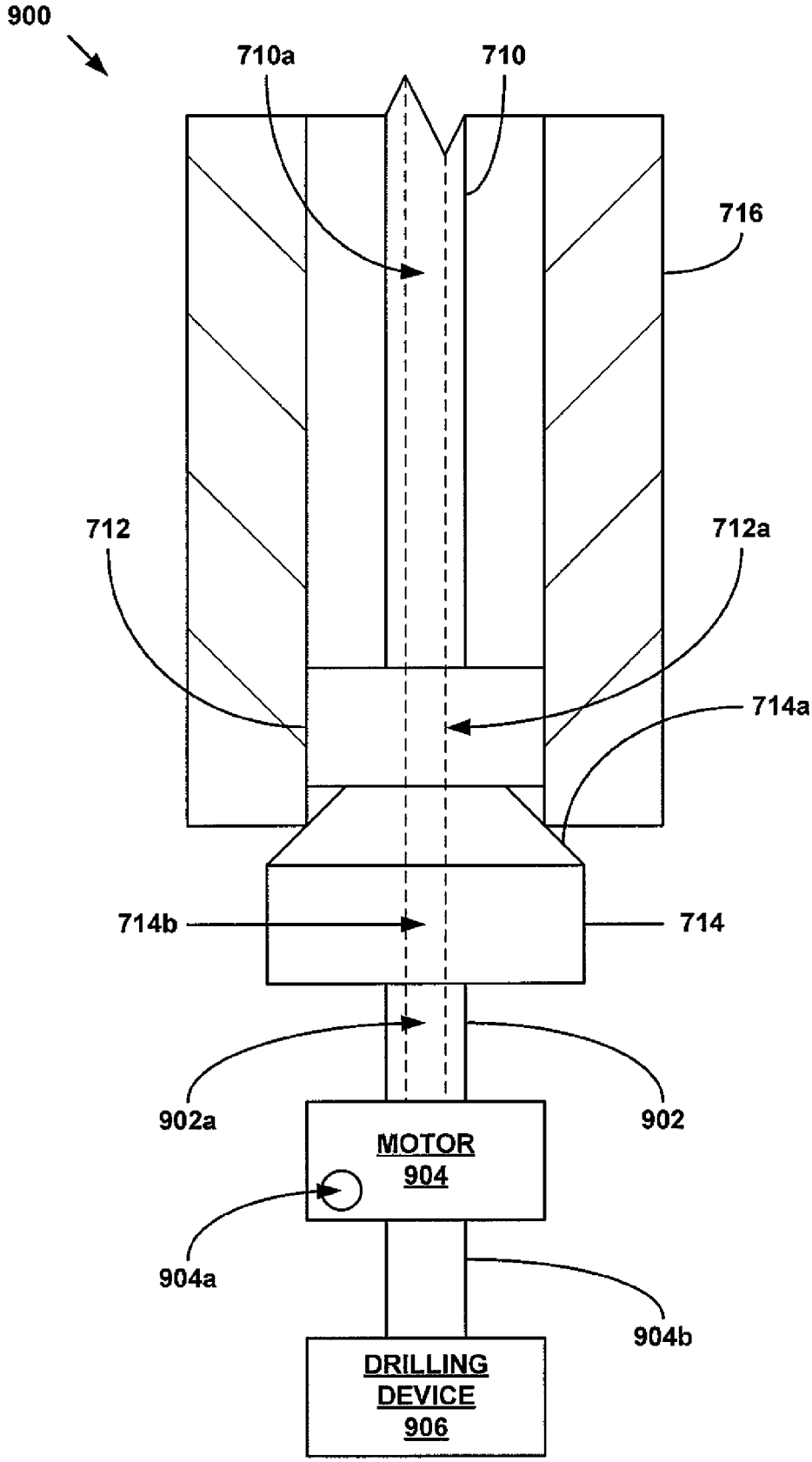

Referring to FIGS. 9*aa* and 9*ab,* in an exemplary embodiment, an expansion and drilling assembly 900 is substantially identical to the expansion assembly 700 except as noted below.

In an exemplary embodiment, the tubular support member 702, the locking device 704, the tubular support member 706, the actuator 708, the tubular support member 710, the release device 712, and the expansion device 714 of the assembly 900 define internal passages, 702*a*, 704*a*, 706*a*, 708*a*, 710*a*, 712*a*, and 714*b*, respectively, that are fluidicly coupled to one another.

In an exemplary embodiment, an end of a tubular support member 902 that defines an internal passage 902*a* is coupled to the other end of the expansion device 914. In an exemplary embodiment, the internal passage 902*a* of the tubular support member 902 is fluidicly coupled to the internal passage 714*b* of the expansion device 714.

In an exemplary embodiment, another end of the tubular support member 902 is coupled to a conventional fluid powered motor 904 that includes one or more exhaust ports 904*a* for exhausting fluidic materials from the motor and an output shaft 904*b*.

In an exemplary embodiment, a conventional drilling device 906 is coupled to an end of the output shaft 904*b* of the motor 904. In an exemplary embodiment, the drilling device 906 may include a conventional underreamer.

Figure 9B:
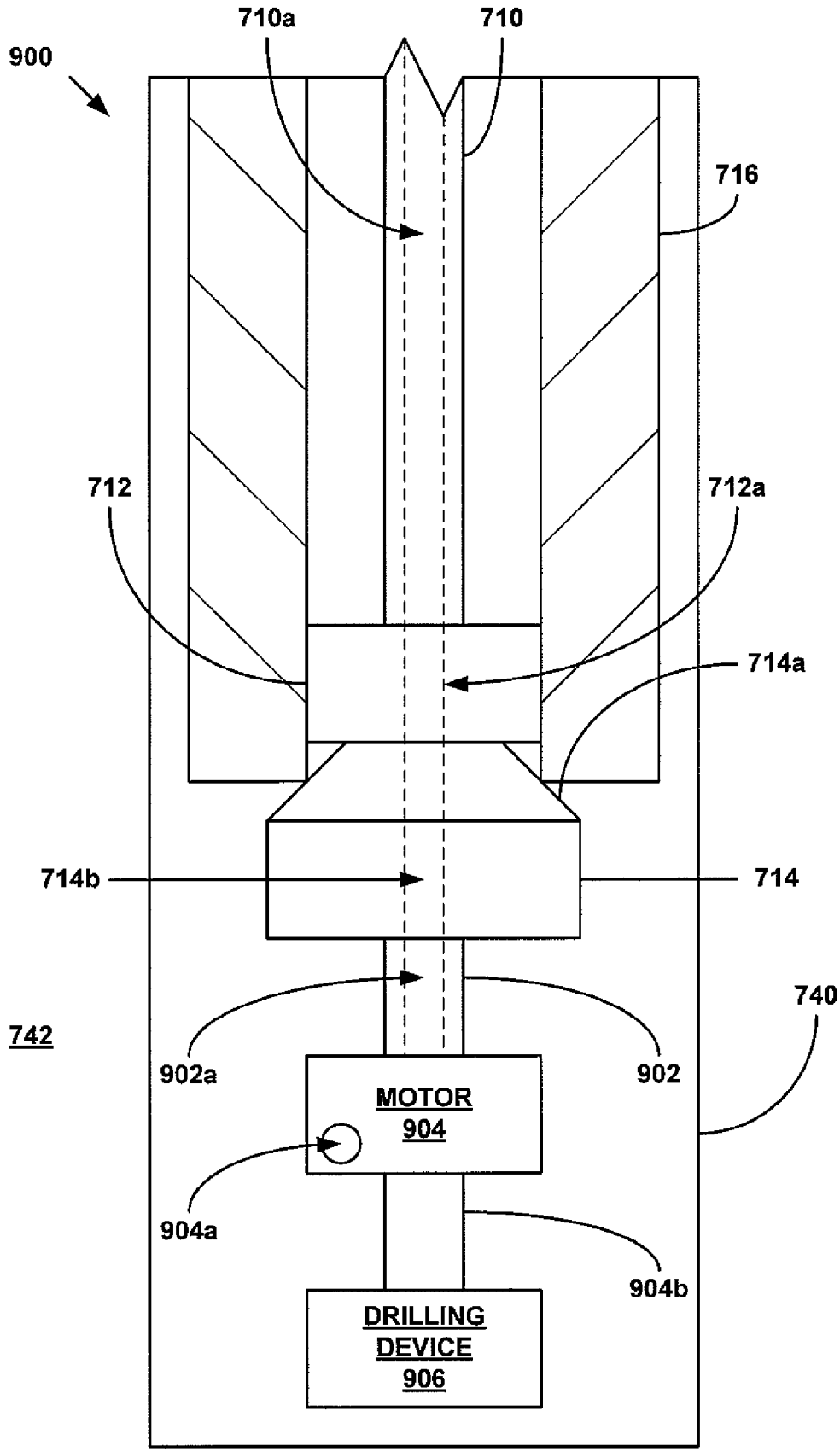
FIG. 9*b* is a fragmentary cross-sectional illustration of the placement of the expansion and drilling device assembly of FIG. 9*a* within a wellbore that traverses a subterranean formation.

In an exemplary embodiment, during operation of the assembly 900, as illustrated in FIG. 9*b*, the assembly is positioned within the wellbore 740.

Figure 9C:
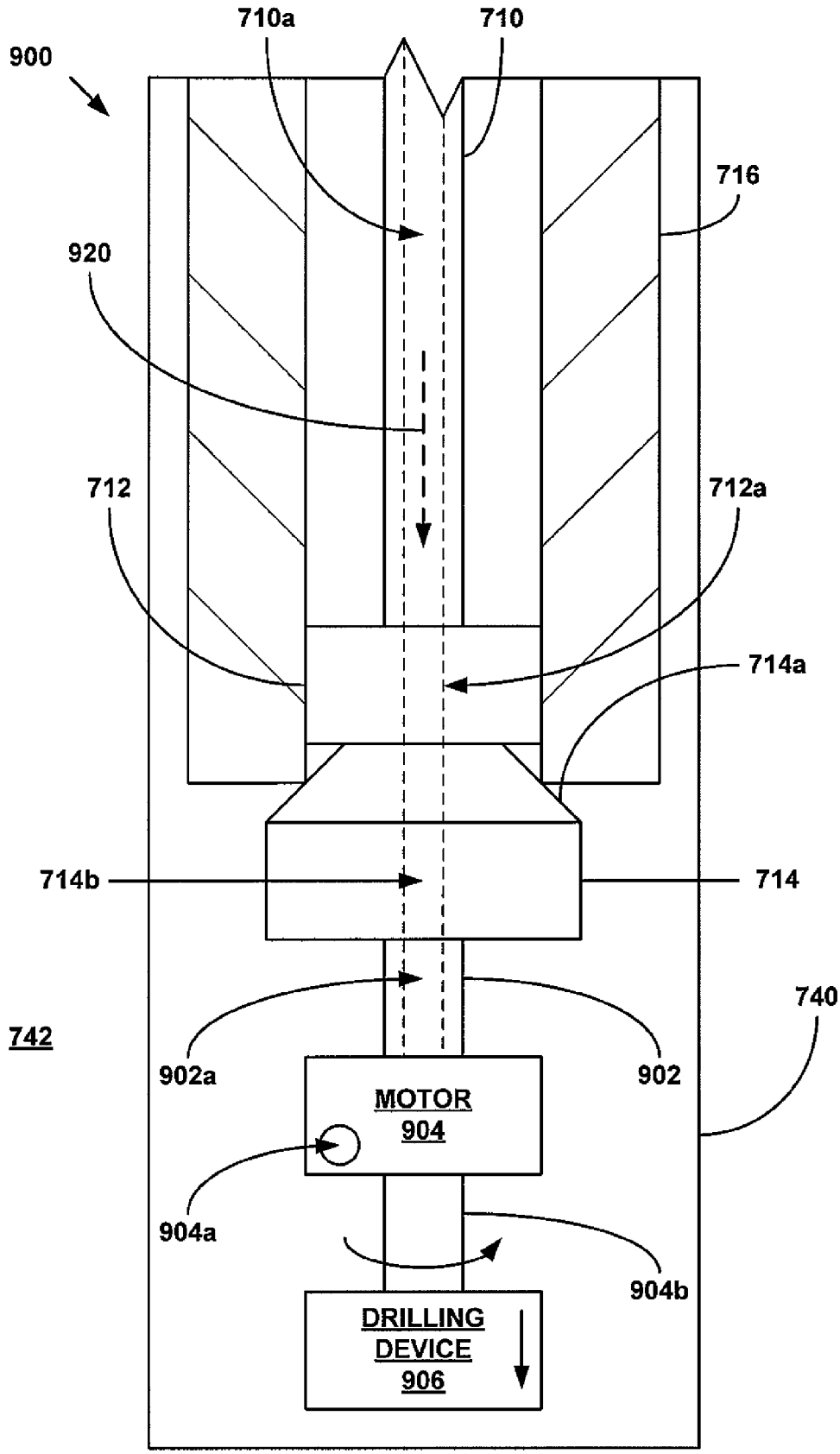
FIG. 9*c* is a fragmentary cross-sectional illustration of the operation of the expansion and drilling device assembly of FIG. 9*b* to drill within the wellbore.

In an exemplary embodiment, during further operation of the assembly 900, as illustrated in FIG. 9*c*, a fluidic material 920 is injected into the assembly through the passages 702*a*, 704*a*, 706*a*, 708*a*, 710*a*, 712*a*, 714*b*, and 902*a* to thereby operate the motor 904. As a result, the output shaft 904*b* of the motor 904 operates the drilling device 906 thereby extending the size and/or length of the wellbore 740.

Figure 9D:
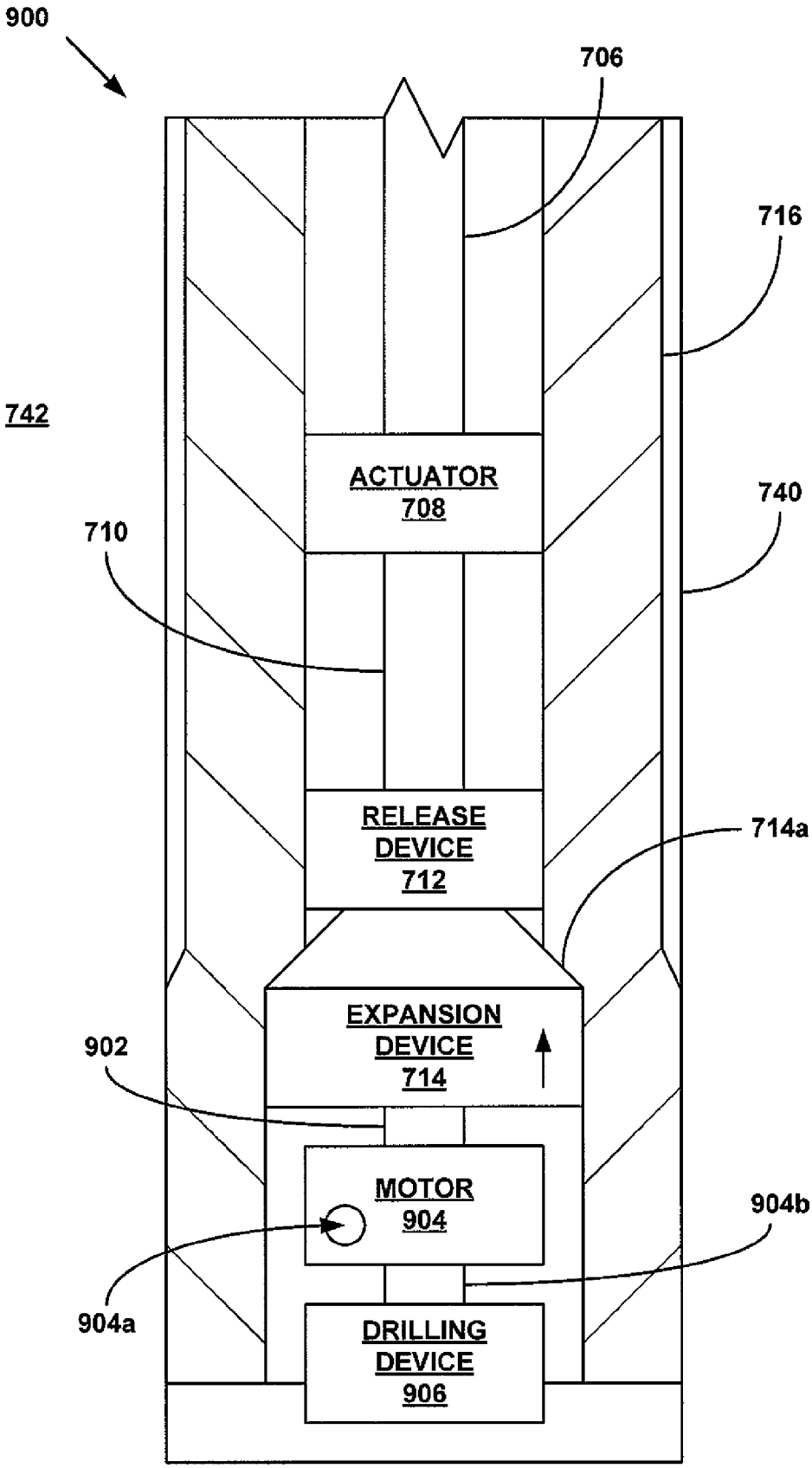
FIG. 9*d* is a fragmentary cross-sectional illustration of the operation of the expansion and device assembly of FIG. 9*c* within the wellbore to radially expand and plastically deform a lower portion of a tubular member.

Referring now to FIG. 9*d*, in an exemplary embodiment, during the continued operation of the assembly 900, the locking device 704 is operated to engage and lock the position of the expandable tubular member 716 relative to the locking device. In an exemplary embodiment, the actuator 708 is then operated to displace the expansion device 714 upwardly relative to the locking device 704. As a result, the lower portion of the expandable tubular member 716 is thereby radially expanded and plastically deformed. Furthermore, in an exemplary embodiment, as a result, at least a portion of the expandable tubular member 716 is radially expanded and plastically deformed into engagement with the surrounding subterranean formation 742. Furthermore, in an exemplary embodiment, as a result, at least a portion of the surrounding subterranean formation 742 is elastically deformed following the radial expansion and plastic deformation of the lower portion of the expandable tubular member 716.

Figure 9E:
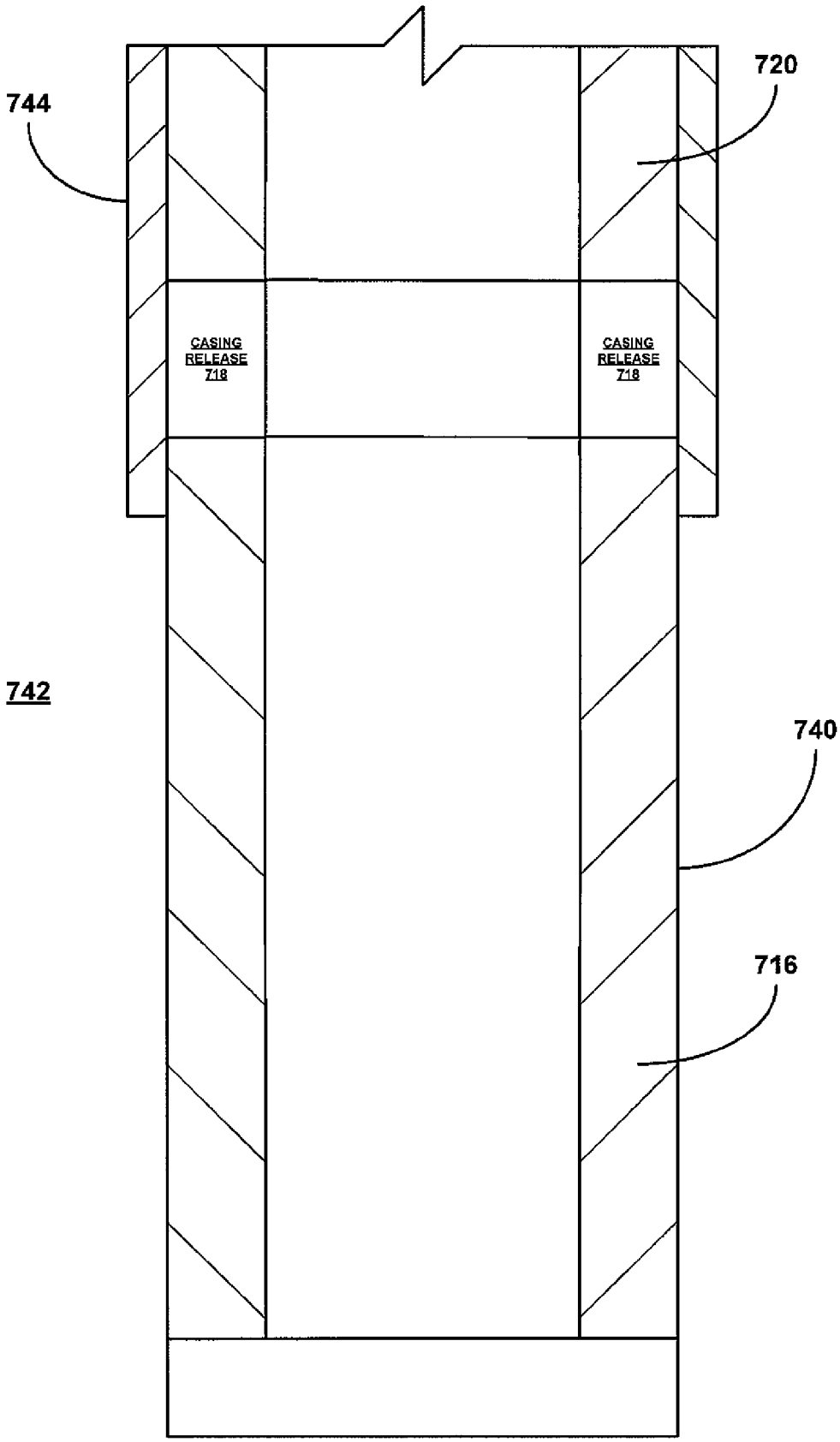
FIG. 9*e* is a fragmentary cross-sectional illustration of the further operation of the expansion and drilling device assembly of FIG. 9*d* within the wellbore to further radially expand and plastically deform the tubular member.

Referring now to FIG. 9*e*, in an exemplary embodiment, the assembly 900 may be further operated to radially expand and plastically deform the remaining portion of the expandable tubular member 716, the casing release 718 and at least a portion of the expandable tubular member 720 by applying a upward tensile load on an end of the tubular support member 702.

In an alternative embodiment, the assembly 900 may be further operated to radially expand and plastically deform the remaining portion of the expandable tubular member 716, the casing release 718 and at least a portion of the expandable tubular member 720 by resetting the actuator 708 and then re-stroking the actuator 708. In an alternative embodiment, during the re-stroking of the actuator 708, an upward tensile load may also be applied to the end of the tubular support member 702.

Figure 10:
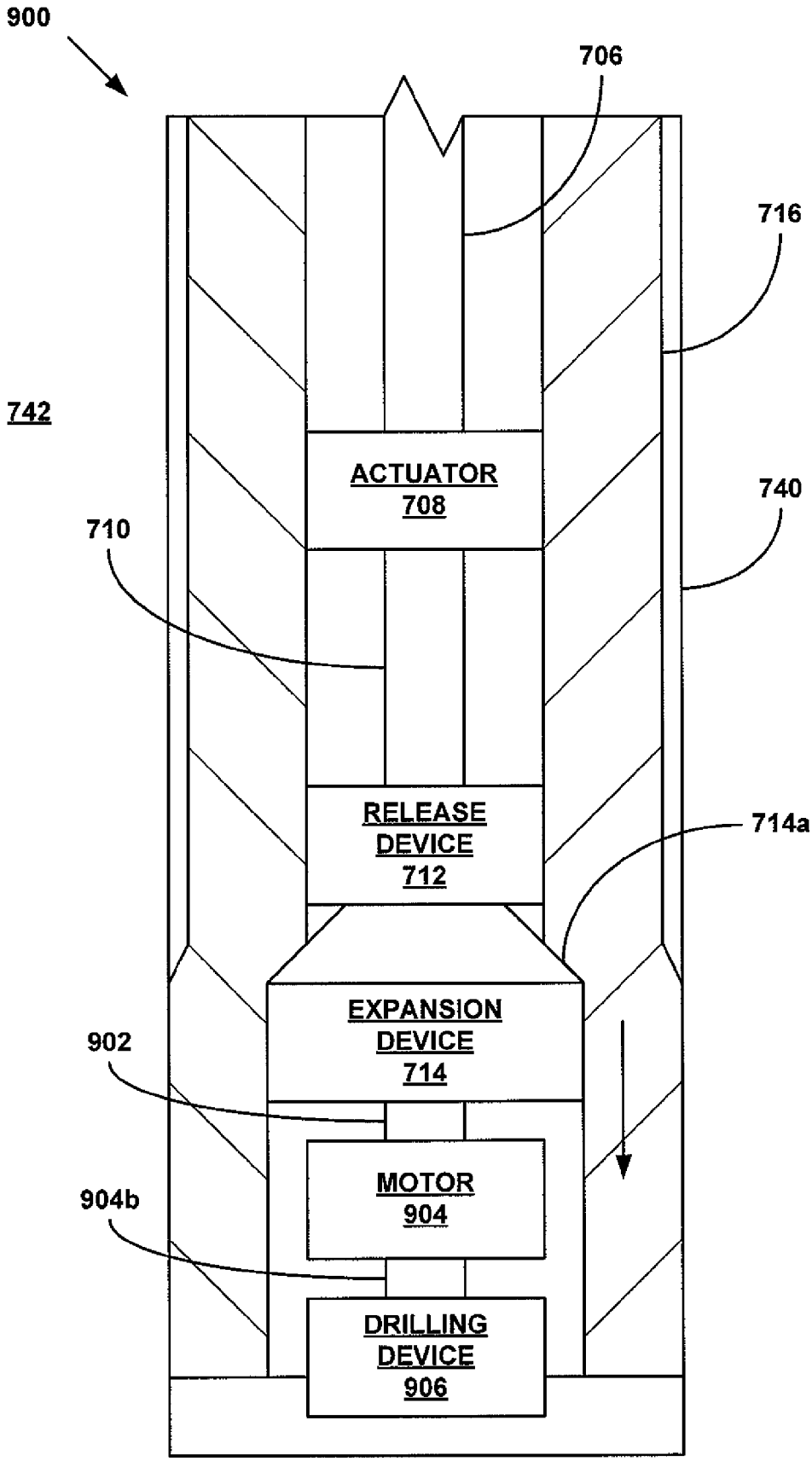
FIG. 10 is a fragmentary cross-sectional illustration of an alternative embodiment of the operation of the expansion and drilling device assembly of FIG. 9*d* within the wellbore to radially expand and plastically deform a lower portion of a tubular member.

Referring to FIG. 10, in an alternative embodiment, during the operation of the assembly 900, the locking device 704 is operated to engage and lock the position of the expandable tubular member 716 relative to the locking device. In an exemplary embodiment, the actuator 708 is then operated to displace the expandable tubular member 716 downwardly relative to the expansion device 714. As a result, the lower portion of the expandable tubular member 716 is thereby radially expanded and plastically deformed. Furthermore, in an exemplary embodiment, as a result, at least a portion of the expandable tubular member 716 is radially expanded and plastically deformed into engagement with the surrounding subterranean formation 742. Furthermore, in an exemplary embodiment, as a result, at least a portion of the surrounding subterranean formation 742 is elastically deformed following the radial expansion and plastic deformation of the lower portion of the expandable tubular member 716.

Figure 11A:
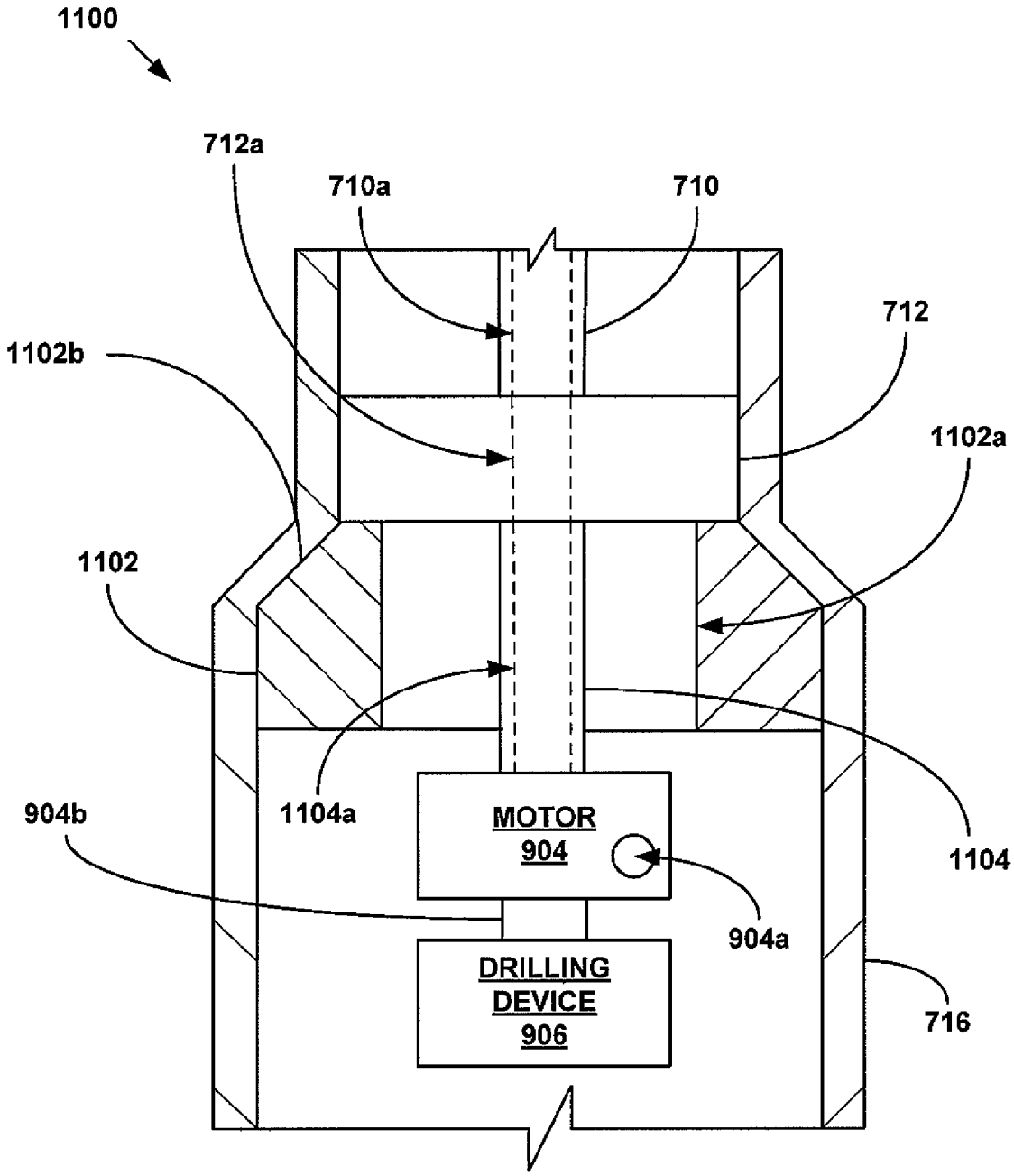
FIG. 11*a* is a fragmentary cross-sectional illustration of an exemplary embodiment of an expansion and drilling sub-assembly.

Referring to FIG. 11*a*, in an alternative embodiment, an expansion and drilling assembly 1100 is substantially identical in design and operation to the assembly 900 except that the expansion device 714 is replaced with an expansion device 1102 that defines a passage 1102*a* and includes one or more tapered expansion surfaces 1102*b* and the tubular support member 902 is replaced with a tubular support member 1104 that defines a passage 1104*a* having an end that is coupled to the release device 712 and another end that is coupled to the motor 904. In an exemplary embodiment, the passage 1104*a* of the tubular support member 1104 is fluidicly coupled to the passages 712*a* of the tubular support member and the motor 904. In an exemplary embodiment, the inside diameter of the passage 1102*a* of the expansion device 1102 is greater than the outside diameters of both the motor 904 and the drilling device 906 thereby permitting both to pass through the passage.

Figure 11B:
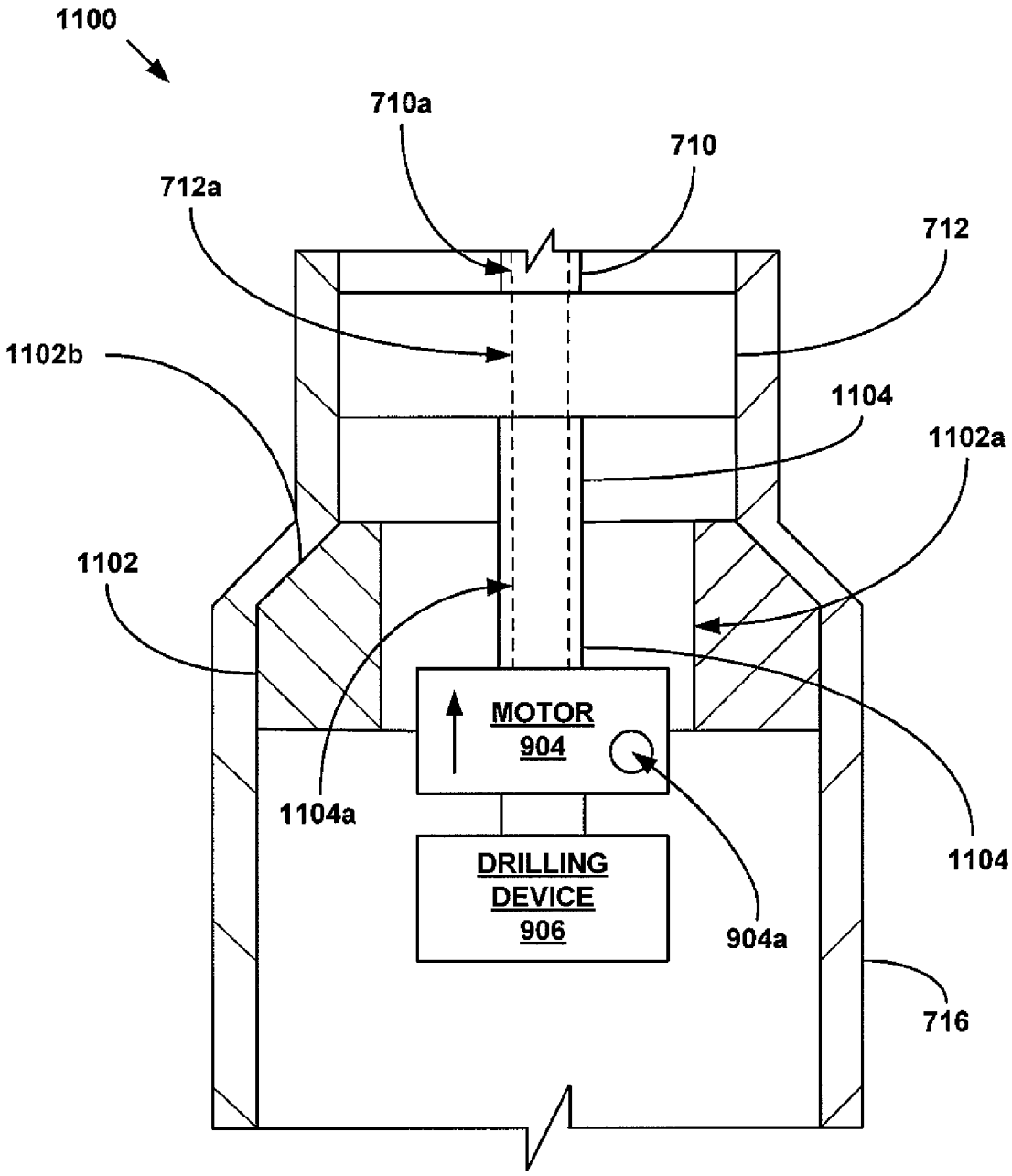
FIGS. 11*b* and 11 *c* are fragmentary cross-sectional illustrations of an exemplary embodiment of the operation of the expansion and drilling sub-assembly of FIG. 11*a*.
Figure 11C:
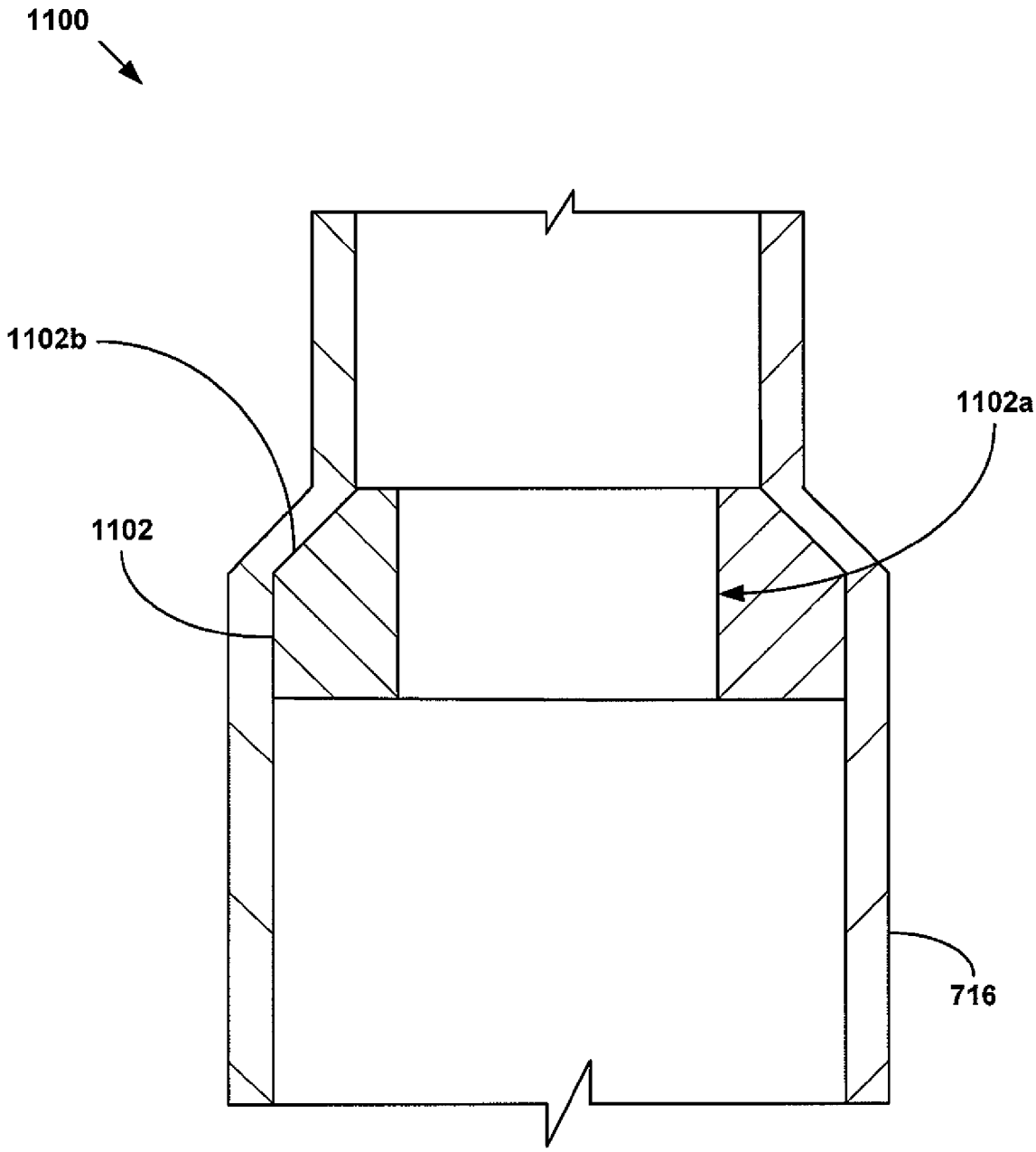

In an exemplary embodiment, during the operation of the assembly 1100, as illustrated in FIGS. 11*b* and 11*c*, the release device 712 may be operated to disengage the release device from the expansion device 1102 thereby permitting the motor 904 and drilling device 906 to be removed from the assembly by lifting the motor and drilling device upwardly through the passage 1102*a* defined within the expansion device 1102.

In an exemplary embodiment, during the operation of the assembly 1100, the motor 904 and drilling device 906 may be removed from the assembly after the insertion of the assembly into the wellbore 740, either before or after the initiation and/or completion of the expansion process.

Figure 12A:
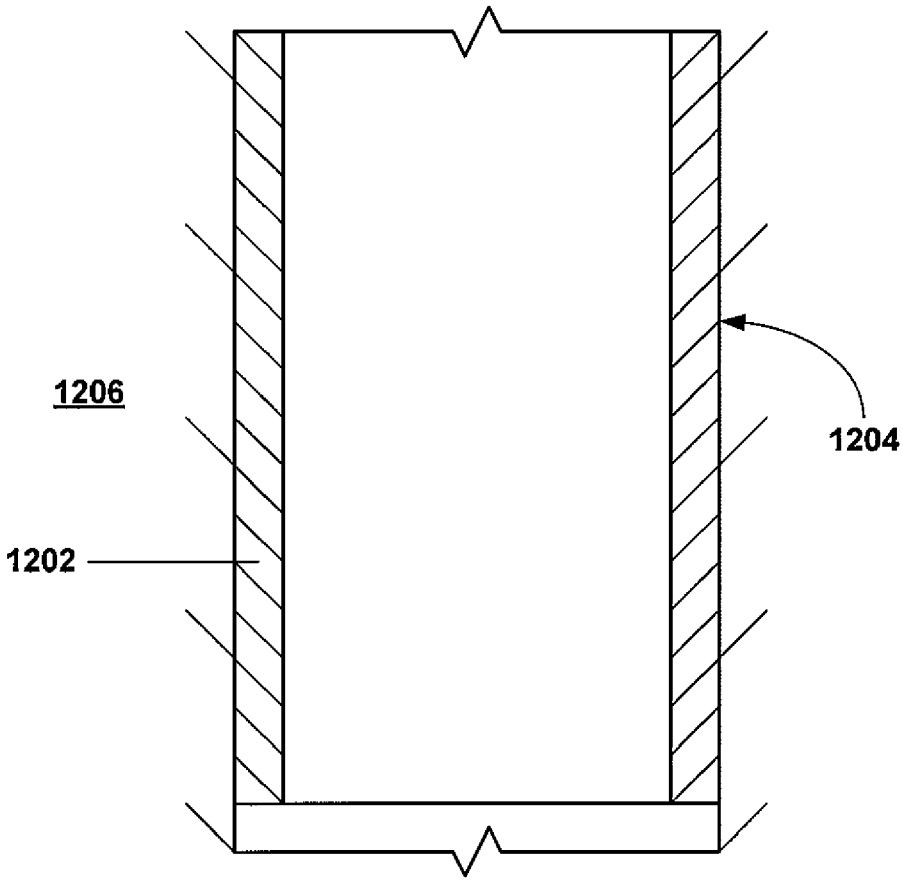
FIGS. 12*a* to 12*c* are fragmentary cross-sectional illustrations of an exemplary embodiment of the operation of an expansion system for forming a mono-diameter wellbore casing.

Referring now to FIG. 12*a*, in an exemplary embodiment, a wellbore casing 1202 is coupled to a wellbore 1204 that traverses a subterranean formation 1206. In an exemplary embodiment, the wellbore casing 1202 is radially expanded and plastically deformed into engagement with the surrounding forming 1206 using one or more of the apparatus and methods described above with reference to FIGS. 1 to 11*c*.

Figure 12B:
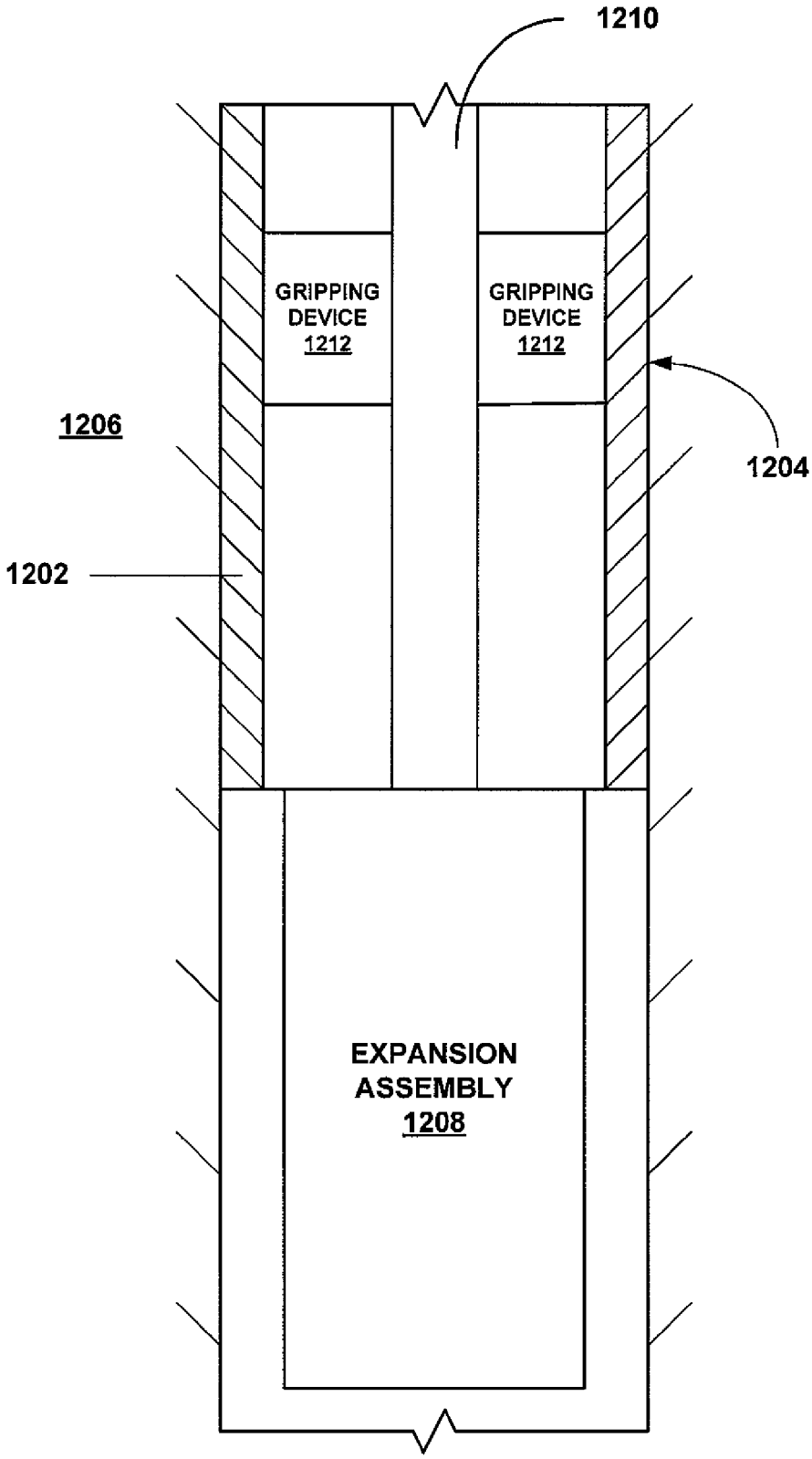

In an exemplary embodiment, as illustrated in FIG. 12*b*, the wellbore 1204 is then in a convention manner using a drilling device and an expansion assembly 1208 is then positioned within the wellbore using a tubular support member 1210 coupled to an end of the expansion assembly. In an exemplary embodiment, a gripping device 1212 is coupled to the tubular support member 1210 for locking the position of the tubular support member to, for example, the wellbore casing 1202.

In an exemplary embodiment, the design and operation of the expansion assembly 1208 may include one or more of the apparatus and methods described above with reference to FIGS. 1 to 11*c*. In an exemplary embodiment, the gripping device 1212 may include a conventional commercially available gripping device.

In an exemplary embodiment, after positioning the expansion assembly 1208 at a predetermined position within the wellbore 1204, the gripping device 1212 is operated to engage the wellbore casing 1202 thereby locking the position of the tubular support member 1210 to the wellbore casing.

Figure 12C:
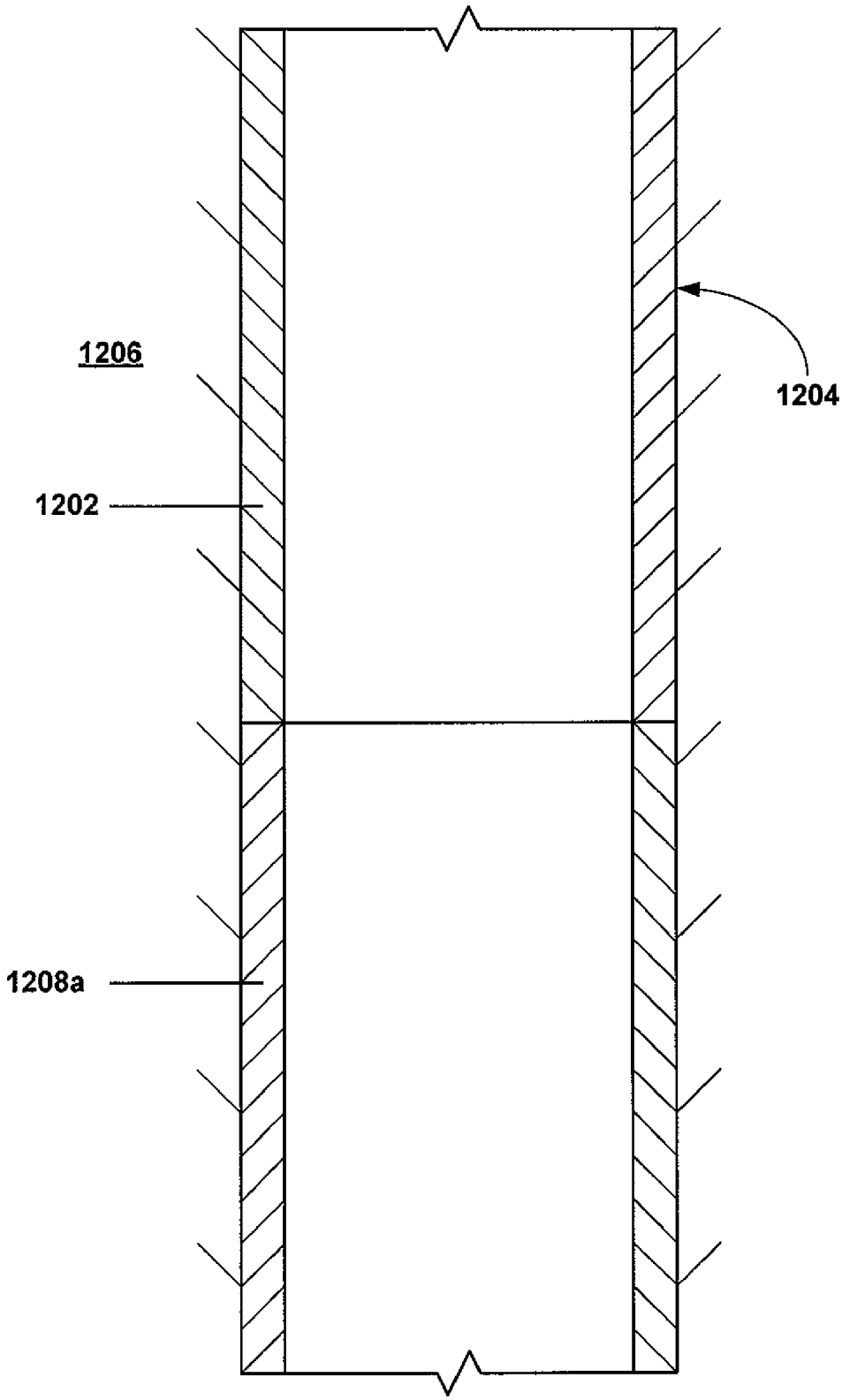

In an exemplary embodiment, as illustrated in FIG. 12*c,* the expansion assembly 1208 is then operated to radially expand and plastically deform a wellbore casing 1208*a* into engagement with the surrounding forming 1206.

In an exemplary embodiment, the inside diameters of the wellbore casings 1202 and 1208*a* are substantially identical. As a result, a mono-diameter wellbore casing is formed within the wellbore.

Figure 13A:
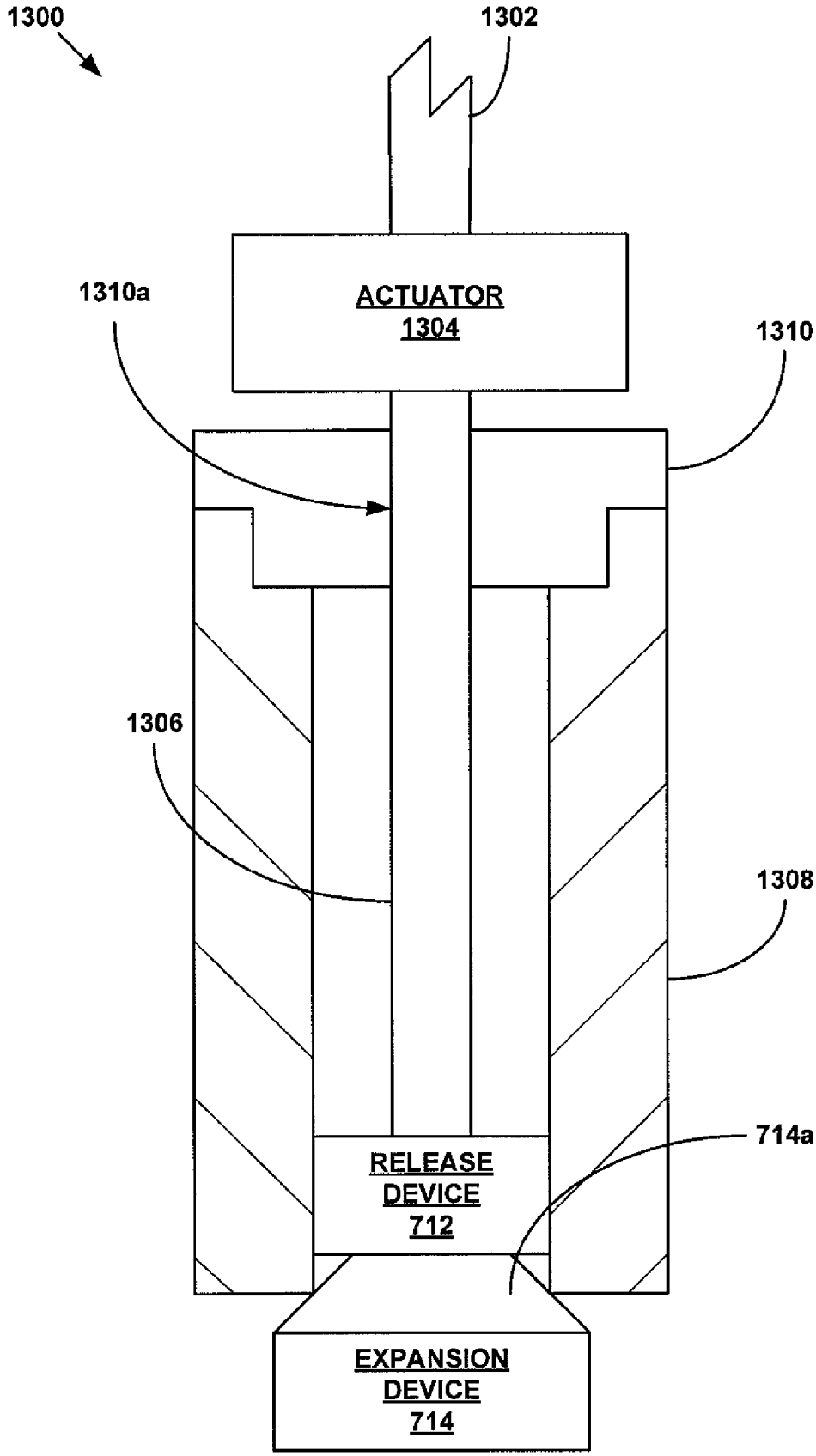
FIGS. 13*a* to 13*d* are fragmentary cross-sectional illustrations of an exemplary embodiment of an expansion system.

Referring now to FIG. 13*a,* an exemplary embodiment of a drilling device assembly 1300, that in some respects is similar in design and operation to the drilling device assembly 700, includes a tubular support member 1302 having an end that is coupled to an end of an actuator 1304. In an exemplary embodiment, the tubular support member 1302 is a conventional drill pipe and the actuator 1304 is a conventional actuator such as, for example, an hydraulic actuator suitable for displacing one or more elements relative to the actuator.

Another end of the actuator 1304 is coupled to an end of a tubular support member 1306 and the other end of the tubular support member is coupled to an end of the release device 712. An end of the expansion device 714 having one or more tapered expansion surfaces 714*a* is coupled to another end of the release device 712.

An end of an expandable tubular member 1308, that receives at least the tubular support member 1306 and the release device 712, is coupled to an supported by the tapered expansion surface 714*a* of the end of the expansion device 714. Another end of the expandable tubular member 1308 is coupled to a locking assembly 1310 that defines a passage 1310*a* that receives the tubular support member 1306. In this manner, the tubular support member 1306 may be displaced relative to and within the passage 1310*a* of the locking assembly 1310.

In an exemplary embodiment, the locking assembly 1310 may be a conventional commercially available locking assembly. In an exemplary embodiment, the locking assembly 1310 may further include one or more slips for engaging the end of the expandable tubular member 1308.

Figure 13B:
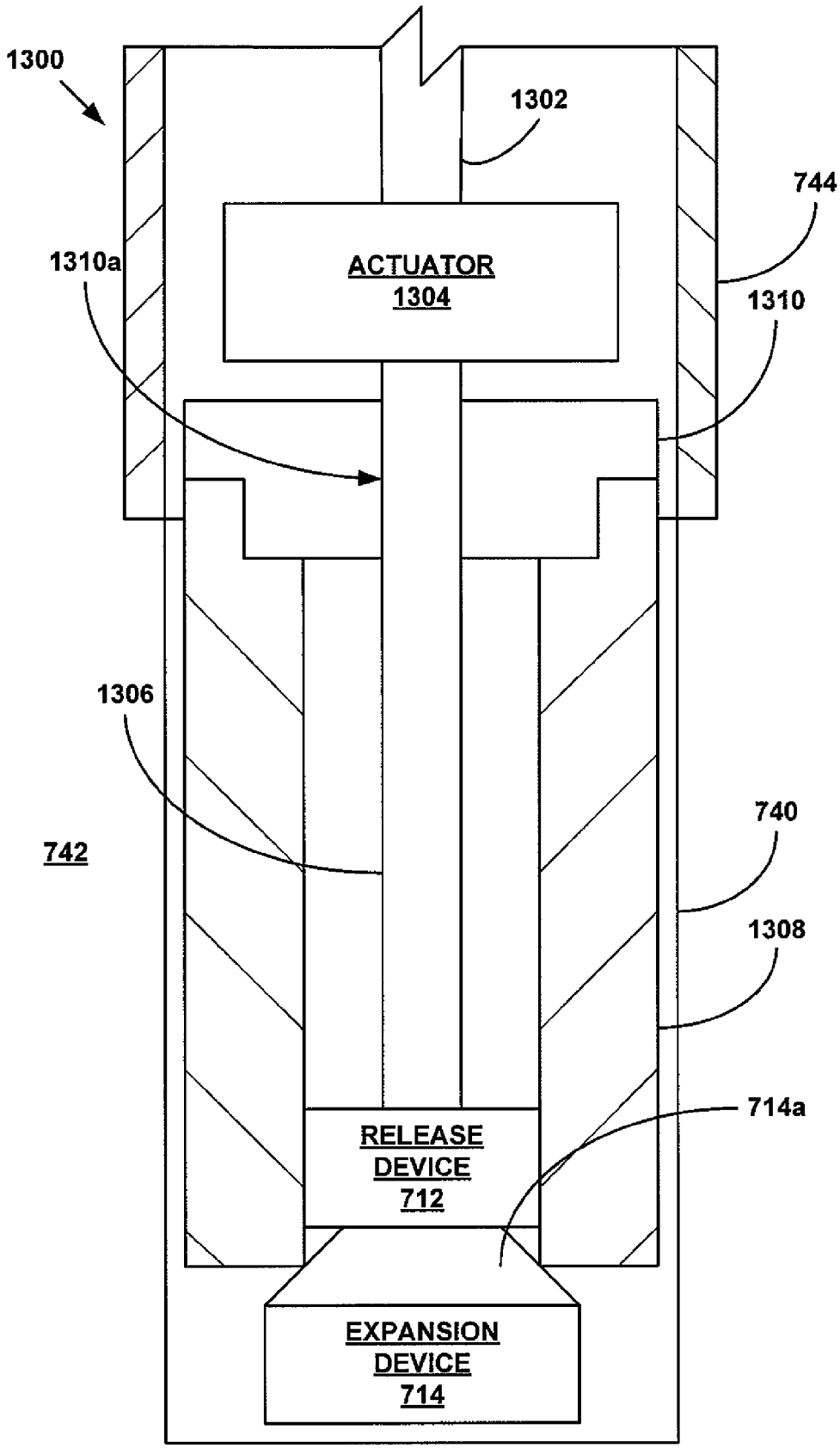

Referring now to FIG. 13*b,* in an exemplary embodiment, during the operation of the expansion device assembly 1300, the assembly is positioned within a wellbore 740 that traverses a subterranean formation 742. In an exemplary embodiment, at least a portion of the wellbore 740 includes a preexisting wellbore casing 744.

Figure 13C:
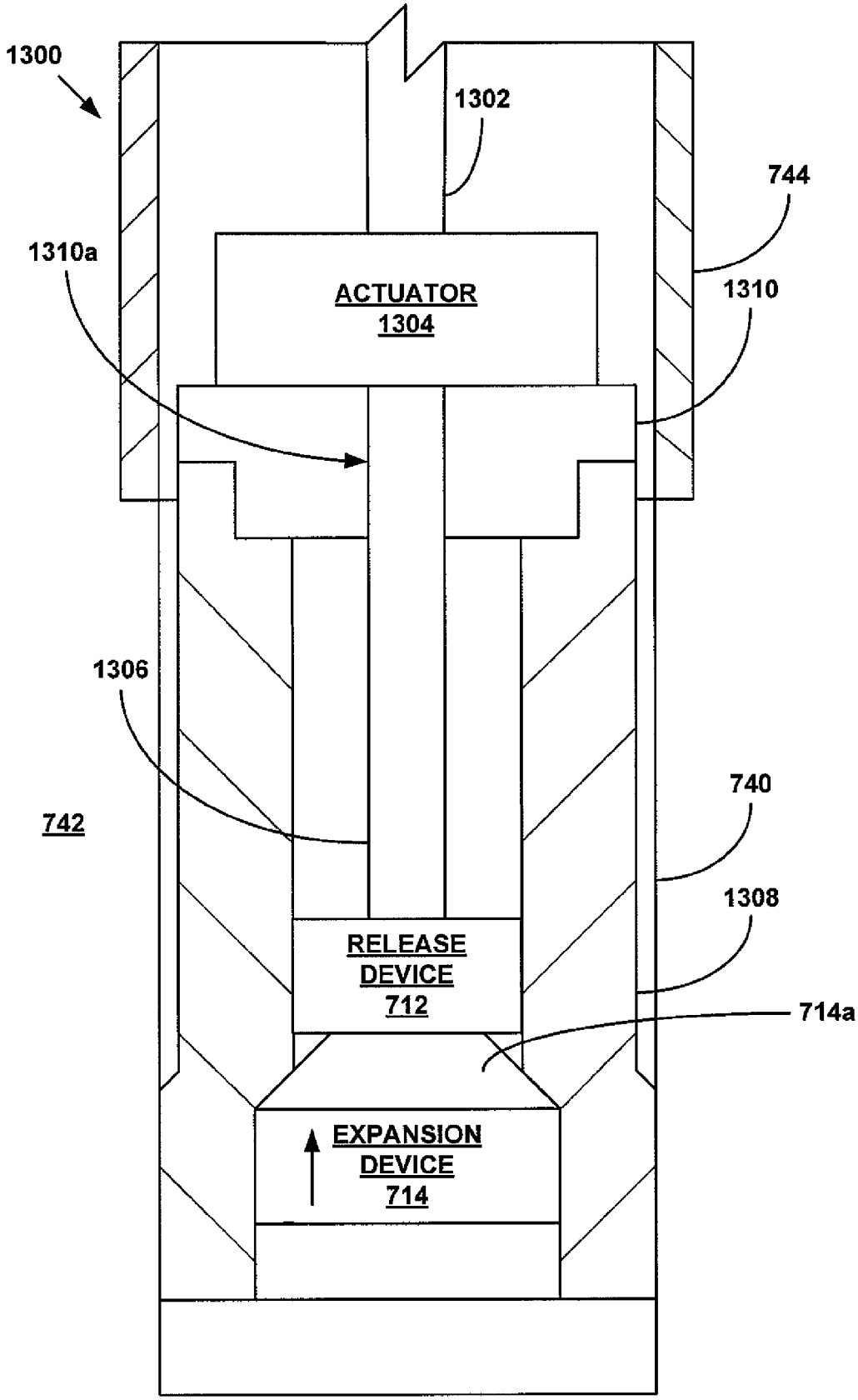

Referring now to FIG. 13*c,* in an exemplary embodiment, during the operation of the expansion device assembly 1308, the locking assembly 1310 engages the end of the expandable tubular member 1308 and the actuator 1304 is operated to displace the tubular support member 1306 and the expansion device 714 upwardly relative to the actuator. As a result, the locking assembly 1310 engages the lower end of the actuator 1304 thereby preventing further upward movement of the expandable tubular member 1308 relative to the actuator 1304. As a result, the lower portion of the expandable tubular member 1308 is radially expanded and plastically deformed by the continued upward displacement of the expansion device 714. Furthermore, in an exemplary embodiment, as a result, at least a portion of the expandable tubular member 1308 is radially expanded and plastically deformed into engagement with the surrounding subterranean formation 742. Furthermore, in an exemplary embodiment, as a result, at least a portion of the surrounding subterranean formation 742 is elastically deformed following the radial expansion and plastic deformation of the lower portion of the expandable tubular member 1308. In an exemplary embodiment, as a result, at least a portion of the lower portion of the expandable tubular member 1308 is anchored to the surrounding subterranean formation 742.

Figure 13D:
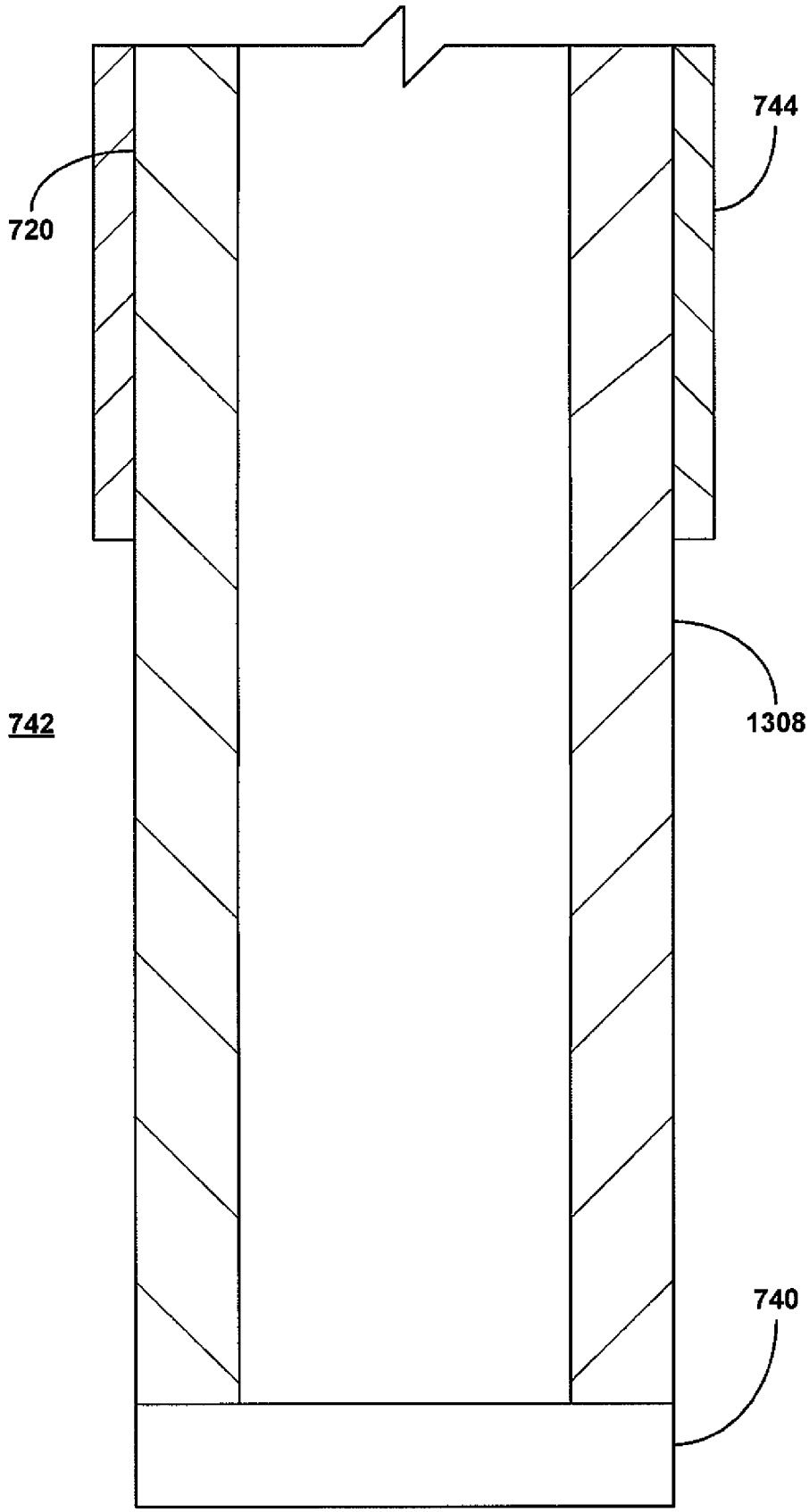

Referring now to FIG. 13*d,* in an exemplary embodiment, the expansion device assembly 1300 may be further operated to radially expand and plastically deform the remaining portion of the expandable tubular member 1308 by applying a upward tensile load on an end of the tubular support member 1302.

In an alternative embodiment, the expansion assembly 1300 may be further operated to radially expand and plastically deform the remaining portion of the expandable tubular member 1308 by continuing to operate the actuator 1304. In an alternative embodiment, during the operation of the actuator 1304, an upward tensile load may also be applied to the end of the tubular support member 1302.

Figure 14A:
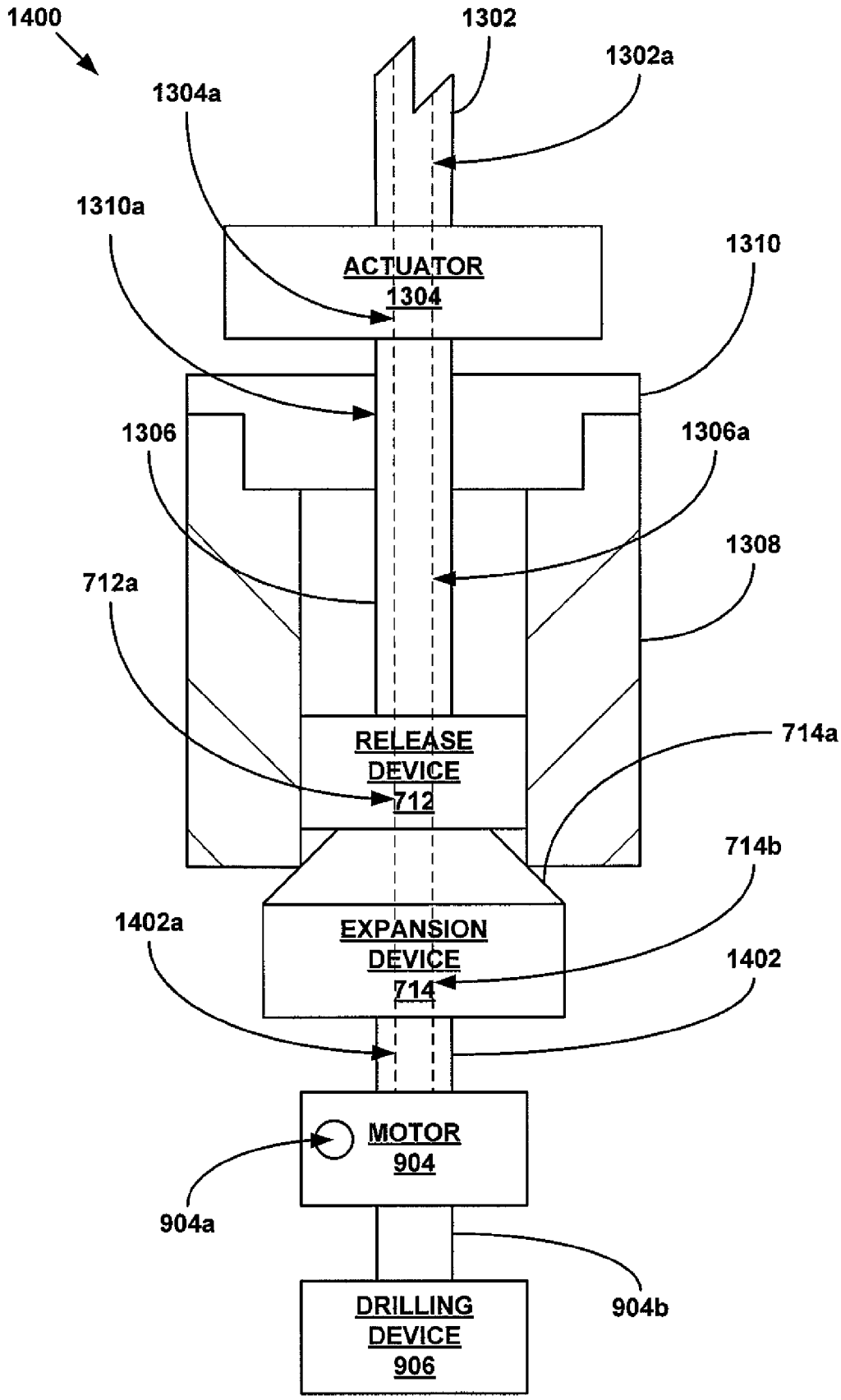
FIG. 14*a* is a fragmentary cross-sectional illustration of an exemplary embodiment of an expansion and drilling system.

Referring now to FIG. 14*a,* an exemplary embodiment of an expansion and drilling assembly 1400 will now be described that includes various aspects of the design and operation of the expansion assembly 1300. In particular, the tubular support member 1302 defines a passage 1302*a* that is fluidicly coupled to a passage 1304*a* defined within the actuator 1304.

The tubular support member 1306 defines a passage 1306*a* that is fluidicly coupled to the passage 1304*a* of the actuator 1304 and the release device 712 defines a passage 712*a* that is fluidicly coupled to the passage 1306*a* defined within the tubular support member. The expansion device 714 defines a passage 714*b* that is fluidicly coupled to the passage 712*a* defined within the release device 712.

An end of a tubular support member 1402 that defines a passage 1402*a* that is fluidicly coupled to the passage 714*b* defined within the expansion device. The passage 1402*a* is also fluidicly coupled to the fluid powered motor 904 that includes an exhaust 904*a* and an output shaft 904*b.* The output shaft 904*b* of the motor 904 is coupled to the drilling device 906.

During operation of the assembly 1400, the assembly may be operated to drill out a wellbore and/or to radially expand and plastically deform the expandable tubular member 1308.

Figure 15:
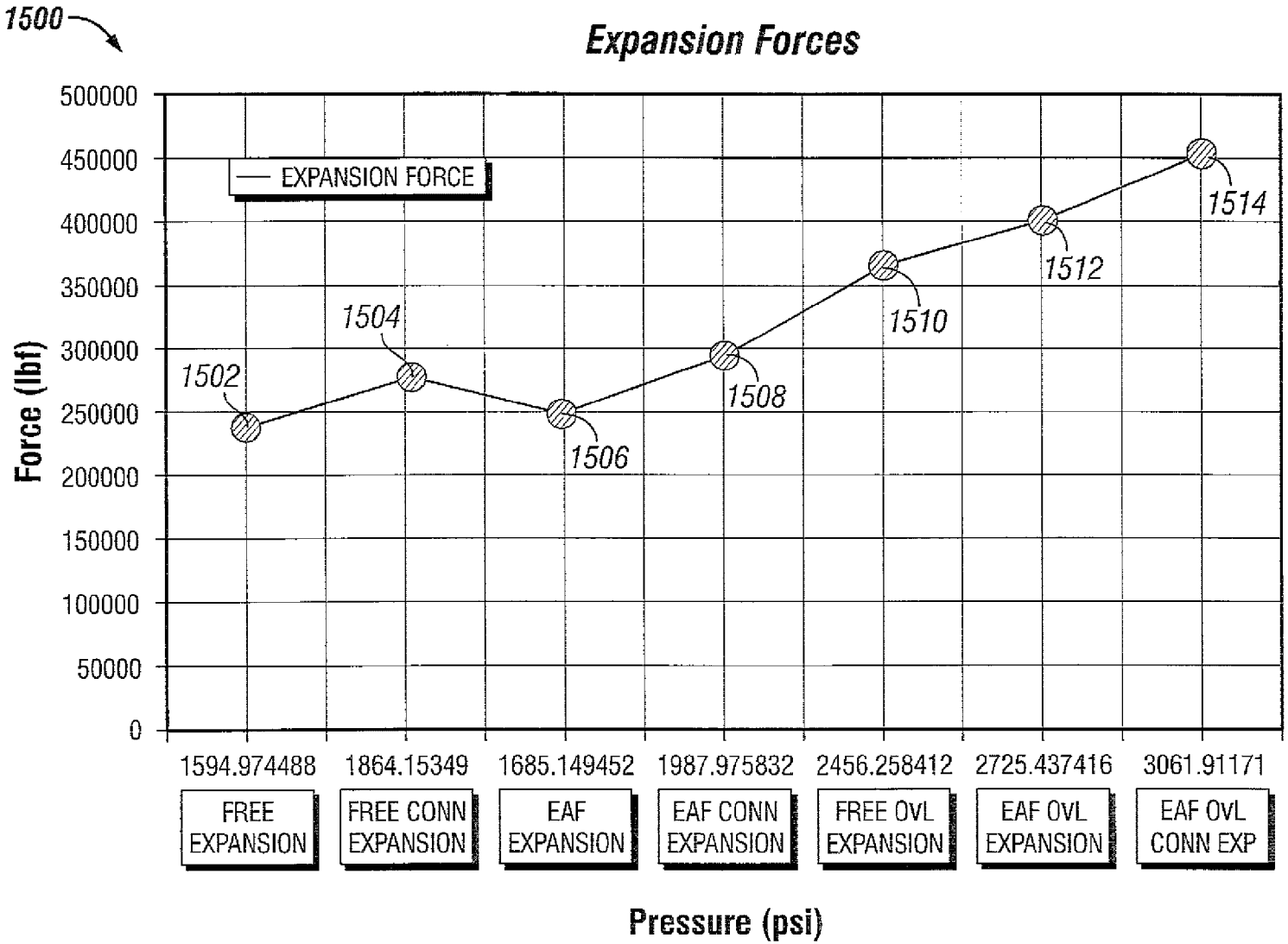
FIG. 15 is a graphical illustration of exemplary experimental results obtained during operation of the expansion system of FIGS. 7*aa* to 7*f*.

Referring now to FIG. 15, in an exemplary experimental implementation of the expansion assembly 700, the following graphical data 1500 was observed: Free Expansion 1502, Free Conn Expansion 1504, EAF Expansion 1506, EAF Conn Expansion 1508, Free OvL Expansion 1510, EAF OvL Expansion 1512, and EAF OvL Conn Exp 1514.

Free Expansion 1502 refers to pipe body expansion forces without cladding into and or against formation.

Free Conn Expansion 1504 refers to applying expansion forces across connections between adjacent tubulars without cladding into or against formation.

EAF Expansion 1506 refers to the forces required or used for pipe body expansion cladding into and or against the formation.

EAF Conn Expansion 1508 refers to the forces required or used for expanding the connections between adjacent tubulars while cladding into and or against the formation.

Free OvL Expansion 1510 refers to the expansion forces across the overlap which includes pipe against pipe without cement or formation behind the outer pipe.

EAF OvL Expansion 1512 refers to expansion forces across an overlap between inner and outer tubulars while cladding into or against the formation.

EAF OvL Conn Exp 1514 refers to the expansion forces across the overlap between inner and outer tubulars with two connections between adjacent tubulars overlaying each other while cladding into or against the formation.

An expandable tubular member has been described that includes: a tubular body; wherein a yield point of an inner tubular portion of the tubular body is less than a yield point of an outer tubular portion of the tubular body. In an exemplary embodiment, the yield point of the inner tubular portion of the tubular body varies as a function of the radial position within the tubular body. In an exemplary embodiment, the yield point of the inner tubular portion of the tubular body varies in an linear fashion as a function of the radial position within the tubular body.

A method of coupling a wellbore casing to the interior surface of a wellbore has been described that includes positioning a wellbore casing within the wellbore and radially expanding and plastically deforming the wellbore casing into engagement with the wellbore to form a fluid tight seal between the casing and the wellbore. In an exemplary embodiment, the fluid tight seal between the casing and the wellbore is capable of sealing off fluidic materials having an operating pressure of up to about 2700 psi. In an exemplary embodiment, the fluid tight seal between the casing and the wellbore is capable of withstanding a tensile load of up to about 180,000 lbf.

An apparatus has been described that includes a wellbore; and a wellbore casing positioned within and engaged with the wellbore to form a fluid tight seal between the casing and the wellbore. In an exemplary embodiment, the fluid tight seal between the casing and the wellbore is capable of sealing off fluidic materials having an operating pressure of up to about 2700 psi. In an exemplary embodiment, the fluid tight seal between the casing and the wellbore is capable of withstanding a tensile load of up to about 180,000 lbf.

A method of determining one or more properties of at least one of a wellbore and a formation traversed by the wellbore has been described that includes radially expanding and plastically deforming a tubular member within the wellbore using an expansion device; monitoring one or more operating parameters of the expansion device; and correlating one or more of the operating parameters of the expansion device to one or more of the properties of at least one of the wellbore and the formation.

An apparatus for radially expanding and plastically deforming a tubular member has been described that includes a support member; a locking device coupled to the support member for controllably locking a position of the tubular member relative to the locking device; an expansion device coupled to the support member for radially expanding and plastically deforming the tubular member; and an actuator coupled to the support member and the expansion device for displacing the expansion device relative to the tubular member. In an exemplary embodiment, an outside diameter of the expansion device is less than or equal to an outside diameter of a bottom end of the tubular member proximate the expansion device. In an exemplary embodiment, the apparatus further includes a tubular release member for releasably coupling an end of the tubular member to an end of another adjacent tubular member member. In an exemplary embodiment, the tubular release member comprises a frangible element coupled between the tubular member and the other tubular member. In an exemplary embodiment, the apparatus further comprises a release device for releasably coupling the expansion device to the actuator. In an exemplary embodiment, the apparatus further includes a drilling device coupled to the support member for drilling a wellbore. In an exemplary embodiment, the expansion device defines a longitudinal passage; and wherein an internal diameter of the longitudinal passage is greater than an outside diameter of the drilling device. In an exemplary embodiment, the apparatus further comprises a motor operably coupled to the drilling device for operating the drilling device. In an exemplary embodiment, the expansion device defines a longitudinal passage; and wherein an internal diameter of the longitudinal passage is greater than an outside diameter of the motor and the drilling device. In an exemplary embodiment, the expansion device defines a longitudinal passage.

An apparatus for radially expanding and plastically deforming a tubular member has been described that includes: a support member; a locking device coupled to the support member for controllably locking a position of the tubular member relative to the locking device; an expansion device coupled to the support member for radially expanding and plastically deforming the tubular member; an actuator coupled to the support member and the expansion device for displacing the expansion device relative to the tubular member; a release device for releasably coupling the expansion device to the actuator; another tubular member; a tubular release member for releasably coupling an end of the tubular member to an end of the other tubular member member; a drilling device coupled to the support member for drilling a wellbore; and a motor operably coupled to the drilling device for operating the drilling device; wherein an outside diameter of the expansion device is less than or equal to an outside diameter of a bottom end of the tubular member proximate the expansion device; wherein the expansion device defines a longitudinal passage; wherein an internal diameter of the longitudinal passage of the expansion device is greater than an outside diameter of the motor and the drilling device; and wherein the tubular release member comprises a frangible element coupled between the tubular member and the other tubular member.

A method of radially expanding and plastically deforming a tubular member within a preexisting structure has been described that includes positioning the tubular member and an expansion device within the preexisting structure using a support member; locking the position of the tubular member relative to the support member; and then displacing the expansion device relative to the tubular member to radially expand and plastically deform the tubular member. In an exemplary embodiment, the method further includes: radially expanding and plastically deforming the tubular member into engagement with the preexisting structure. In an exemplary embodiment, the method further includes: then further displacing the expansion device relative to the tubular member to radially expand and plastically deform the tubular member. In an exemplary embodiment, then further displacing the expansion device relative to the tubular member to radially expand and plastically deform the tubular member comprises: unlocking the position of the tubular member relative to the support member; and then displacing the expansion device relative to the tubular member to radially expand and plastically deform the tubular member. In an exemplary embodiment, the method further comprises: then further displacing the expansion device relative to the tubular member to radially expand and plastically deform the tubular member. In an exemplary embodiment, then further displacing the expansion device relative to the tubular member to radially expand and plastically deform the tubular member comprises: unlocking the position of the tubular member relative to the support member; displacing the support member relative to the tubular member; relocking the position of the tubular member relative to the support member; and then displacing the expansion device relative to the tubular member to radially expand and plastically deform the tubular member. In an exemplary embodiment, the method further comprises: decoupling the expansion device from the tubular support member; and removing the tubular support member from the tubular member. In an exemplary embodiment, the tubular member comprises first and second tubular members coupled to one another; and the method further comprises: decoupling the first and second tubular members; and removing one of the first and second tubular members from the preexisting structure. In an exemplary embodiment, the method further comprises: drilling out the preexisting structure. In an exemplary embodiment, the method further comprises: drilling out the preexisting structure prior to displacing the expansion device relative to the tubular member to radially expand and plastically deform the tubular member. In an exemplary embodiment, the method further comprises: drilling out the preexisting structure after displacing the expansion device relative to the tubular member to radially expand and plastically deform the tubular member. In an exemplary embodiment, the method further comprises: drilling out the preexisting structure using a drilling device; and removing the drilling device from the preexisting structure. In an exemplary embodiment, the method further comprises: removing the drilling device from the preexisting structure prior to displacing the expansion device relative to the tubular member to radially expand and plastically deform the tubular member. In an exemplary embodiment, the method further comprises: removing the drilling device from the preexisting structure after displacing the expansion device relative to the tubular member to radially expand and plastically deform the tubular member. In an exemplary embodiment, the method further comprises: locking a position of the support member to the preexisting structure; and then displacing the expansion device relative to the tubular member to radially expand and plastically deform the tubular member. In an exemplary embodiment, the preexisting structure comprises a wellbore that traverses a subterranean formation. In an exemplary embodiment, the preexisting structure further comprises a wellbore casing positioned within the wellbore that is coupled to the subterranean formation.

A method of radially expanding and plastically deforming a tubular member within a preexisting structure has been described that includes: positioning the tubular member and an expansion device within the preexisting structure using a support member; locking the position of the tubular member relative to the support member; then displacing the expansion device relative to the tubular member to radially expand and plastically deform the tubular member into engagement with the preexisting structure; and then further displacing the expansion device relative to the tubular member to further radially expand and plastically deform the tubular member; wherein then further displacing the expansion device relative to the tubular member to further radially expand and plastically deform the tubular member comprises one or more of: unlocking the position of the tubular member relative to the support member; and then displacing the expansion device relative to the tubular member to radially expand and plastically deform the tubular member; or unlocking the position of the tubular member relative to the support member; displacing the support member relative to the tubular member; relocking the position of the tubular member relative to the support member; and then displacing the expansion device relative to the tubular member to radially expand and plastically deform the tubular member.

A method of radially expanding and plastically deforming a tubular member within a preexisting structure has been described that includes positioning the tubular member and an expansion device within the preexisting structure using a support member; locking the position of the tubular member relative to the support member; then displacing the expansion device relative to the tubular member to radially expand and plastically deform the tubular member into engagement with the preexisting structure; then further displacing the expansion device relative to the tubular member to further radially expand and plastically deform the tubular member; decoupling the expansion device from the tubular support member; and removing the tubular support member from the tubular member.

A method of radially expanding and plastically deforming a tubular member assembly, comprising first and second tubular members coupled to one another, within a preexisting structure has been described that includes positioning the tubular member assembly and an expansion device within the preexisting structure using a support member; locking the position of the tubular member assembly relative to the support member; then displacing the expansion device relative to the tubular member assembly to radially expand and plastically deform the tubular member assembly into engagement with the preexisting structure; then further displacing the expansion device relative to the tubular member assembly to further radially expand and plastically deform the tubular member assembly; decoupling the first and second tubular members; and removing one of the first and second tubular members from the preexisting structure.

A method of radially expanding and plastically deforming a tubular member within a preexisting structure has been described that includes positioning the tubular member and an expansion device within the preexisting structure using a support member; locking the position of the tubular member relative to the support member; then displacing the expansion device relative to the tubular member to radially expand and plastically deform the tubular member into engagement with the preexisting structure; drilling out the preexisting structure prior to or after displacing the expansion device relative to the tubular member to radially expand and plastically deform the tubular member using a drilling device; and removing the drilling device from the preexisting structure prior to displacing the expansion device relative to the tubular member to radially expand and plastically deform the tubular member.

A method of radially expanding and plastically deforming a tubular member within a preexisting structure has been described that includes positioning the tubular member and an expansion device within the preexisting structure using a support member; locking a position of the support member to the preexisting structure; locking the position of the tubular member relative to the support member; then displacing the expansion device relative to the tubular member to radially expand and plastically deform the tubular member into engagement with the preexisting structure; and then further displacing the expansion device relative to the tubular member to further radially expand and plastically deform the tubular member; wherein then further displacing the expansion device relative to the tubular member to further radially expand and plastically deform the tubular member comprises one or more of: unlocking the position of the tubular member relative to the support member; and then displacing the expansion device relative to the tubular member to radially expand and plastically deform the tubular member; or unlocking the position of the tubular member relative to the support member; displacing the support member relative to the tubular member; relocking the position of the tubular member relative to the support member; and then displacing the expansion device relative to the tubular member to radially expand and plastically deform the tubular member; and wherein the preexisting structure comprises a wellbore that traverses a subterranean formation; and wherein the preexisting structure further comprises a wellbore casing positioned within the wellbore that is coupled to the subterranean formation.

A system for radially expanding and plastically deforming a tubular member within a preexisting structure has been described that includes means for positioning the tubular member and an expansion device within the preexisting structure using a support member; means for locking the position of the tubular member relative to the support member; and means for then displacing the expansion device relative to the tubular member to radially expand and plastically deform the tubular member. In an exemplary embodiment, the system further comprises: means for radially expanding and plastically deforming the tubular member into engagement with the preexisting structure. In an exemplary embodiment, the system further comprises: means for then further displacing the expansion device relative to the tubular member to radially expand and plastically deform the tubular member. In an exemplary embodiment, then further displacing the expansion device relative to the tubular member to radially expand and plastically deform the tubular member comprises: means for unlocking the position of the tubular member relative to the support member; and means for then displacing the expansion device relative to the tubular member to radially expand and plastically deform the tubular member. In an exemplary embodiment, the system further comprises: means for then further displacing the expansion device relative to the tubular member to radially expand and plastically deform the tubular member. In an exemplary embodiment, then further displacing the expansion device relative to the tubular member to radially expand and plastically deform the tubular member comprises: means for unlocking the position of the tubular member relative to the support member; means for displacing the support member relative to the tubular member; means for relocking the position of the tubular member relative to the support member; and means for then displacing the expansion device relative to the tubular member to radially expand and plastically deform the tubular member. In an exemplary embodiment, the system further comprises: means for decoupling the expansion device from the tubular support member; and means for removing the tubular support member from the tubular member. In an exemplary embodiment, the tubular member comprises first and second tubular members coupled to one another; and wherein the method further comprises: means for decoupling the first and second tubular members; and means for removing one of the first and second tubular members from the preexisting structure. In an exemplary embodiment, the system further comprises: means for drilling out the preexisting structure. In an exemplary embodiment, the system further comprises: means for drilling out the preexisting structure prior to displacing the expansion device relative to the tubular member to radially expand and plastically deform the tubular member. In an exemplary embodiment, the system further comprises: means for drilling out the preexisting structure after displacing the expansion device relative to the tubular member to radially expand and plastically deform the tubular member. In an exemplary embodiment, the system further comprises: means for drilling out the preexisting structure using a drilling device; and means for removing the drilling device from the preexisting structure. In an exemplary embodiment, the system further comprises: means for removing the drilling device from the preexisting structure prior to displacing the expansion device relative to the tubular member to radially expand and plastically deform the tubular member. In an exemplary embodiment, the system further comprises: means for removing the drilling device from the preexisting structure after displacing the expansion device relative to the tubular member to radially expand and plastically deform the tubular member. In an exemplary embodiment, the system further comprises: means for locking a position of the support member to the preexisting structure; and means for then displacing the expansion device relative to the tubular member to radially expand and plastically deform the tubular member. In an exemplary embodiment, the preexisting structure comprises a wellbore that traverses a subterranean formation. In an exemplary embodiment, the preexisting structure further comprises a wellbore casing positioned within the wellbore that is coupled to the subterranean formation.

A system for radially expanding and plastically deforming a tubular member within a preexisting structure has been described that includes means for positioning the tubular member and an expansion device within the preexisting structure using a support member; means for locking the position of the tubular member relative to the support member; means for then displacing the expansion device relative to the tubular member to radially expand and plastically deform the tubular member into engagement with the preexisting structure; and means for then further displacing the expansion device relative to the tubular member to further radially expand and plastically deform the tubular member; wherein means for then further displacing the expansion device relative to the tubular member to further radially expand and plastically deform the tubular member comprises one or more of: means for unlocking the position of the tubular member relative to the support member; and means for then displacing the expansion device relative to the tubular member to radially expand and plastically deform the tubular member; or means for unlocking the position of the tubular member relative to the support member; means for displacing the support member relative to the tubular member; means for relocking the position of the tubular member relative to the support member; and means for then displacing the expansion device relative to the tubular member to radially expand and plastically deform the tubular member.

A system for radially expanding and plastically deforming a tubular member within a preexisting structure has been described that includes: means for positioning the tubular member and an expansion device within the preexisting structure using a support member; means for locking the position of the tubular member relative to the support member; means for then displacing the expansion device relative to the tubular member to radially expand and plastically deform the tubular member into engagement with the preexisting structure; means for then further displacing the expansion device relative to the tubular member to further radially expand and plastically deform the tubular member; means for decoupling the expansion device from the tubular support member; and means for removing the tubular support member from the tubular member.

A system for radially expanding and plastically deforming a tubular member assembly, comprising first and second tubular members coupled to one another, within a preexisting structure has been described that includes: means for positioning the tubular member assembly and an expansion device within the preexisting structure using a support member; means for locking the position of the tubular member assembly relative to the support member; means for then displacing the expansion device relative to the tubular member assembly to radially expand and plastically deform the tubular member assembly into engagement with the preexisting structure; means for then further displacing the expansion device relative to the tubular member assembly to further radially expand and plastically deform the tubular member assembly; means for decoupling the first and second tubular members; and means for removing one of the first and second tubular members from the preexisting structure.

A system for radially expanding and plastically deforming a tubular member within a preexisting structure has been described that includes: means for positioning the tubular member and an expansion device within the preexisting structure using a support member; means for locking the position of the tubular member relative to the support member; means for then displacing the expansion device relative to the tubular member to radially expand and plastically deform the tubular member into engagement with the preexisting structure; means for drilling out the preexisting structure prior to or after displacing the expansion device relative to the tubular member to radially expand and plastically deform the tubular member using a drilling device; and means for removing the drilling device from the preexisting structure prior to displacing the expansion device relative to the tubular member to radially expand and plastically deform the tubular member.

A system for radially expanding and plastically deforming a tubular member within a preexisting structure has been described that includes: means for positioning the tubular member and an expansion device within the preexisting structure using a support member; means for locking a position of the support member to the preexisting structure; means for locking the position of the tubular member relative to the support member; means for then displacing the expansion device relative to the tubular member to radially expand and plastically deform the tubular member into engagement with the preexisting structure; and means for then further displacing the expansion device relative to the tubular member to further radially expand and plastically deform the tubular member; wherein means for then further displacing the expansion device relative to the tubular member to further radially expand and plastically deform the tubular member comprises one or more of: means for unlocking the position of the tubular member relative to the support member; and means for then displacing the expansion device relative to the tubular member to radially expand and plastically deform the tubular member; or means for unlocking the position of the tubular member relative to the support member; means for displacing the support member relative to the tubular member; means for relocking the position of the tubular member relative to the support member; and means for then displacing the expansion device relative to the tubular member to radially expand and plastically deform the tubular member; and wherein the preexisting structure comprises a wellbore that traverses a subterranean formation; and wherein the preexisting structure further comprises a wellbore casing positioned within the wellbore that is coupled to the subterranean formation. A method of forming a wellbore casing system within a wellbore that traverses a subterranean formation has been described that includes: radially expanding and plastically deforming a first tubular member within a first portion of the wellbore; and then radially expanding and plastically deforming a second tubular member within a second portion of the wellbore using any one of the methods or apparatus described above. In an exemplary embodiment, the method further comprises: radially expanding and plastically deforming a first tubular member within a first portion of the wellbore using any one of the methods or apparatus described above. In an exemplary embodiment, an inside diameter of the first and second tubular members are substantially identical.

It is understood that variations may be made in the foregoing without departing from the scope of the invention. For example, the teachings of the present illustrative embodiments may be used to provide a wellbore casing, a pipeline, or a structural support. Furthermore, the elements and teachings of the various illustrative embodiments may be combined in whole or in part in some or all of the illustrative embodiments. In addition, one or more of the elements and teachings of the various illustrative embodiments may be omitted, at least in part, and/or combined, at least in part, with one or more of the other elements and teachings of the various illustrative embodiments.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. An apparatus for radially expanding and plastically deforming a tubular member, comprising:

a support member;

an expansion cone disposed at a lower end of the tubular member and configured to radially expand the tubular member;

an actuator coupled to the support member and the expansion cone and configured to pull the expansion cone through at least a portion of the tubular member;

a releasable locking device configured to limit displacement of the tubular member relative to the actuator during actuation; and a drilling device disposed below the expansion cone and having a drilling diameter greater than an outer diameter of the tubular member before expansion, wherein the drilling device is in fluid communication with the support member, wherein the expansion cone comprises a longitudinal passage, and wherein an internal diameter of the longitudinal passage is greater than an outside diameter of the drilling device.

2. The apparatus of claim 1, further comprising:

a motor disposed between the expansion cone and the drilling device.

3. The apparatus of claim 1, further comprising:

a release device for releasably coupling the expansion cone to the actuator.

4. The apparatus of claim 1, wherein the actuator is hydraulically operated.

5. A method of drilling and lining a wellbore, comprising:

operably coupling a support member to a drilling device, an expansion cone configured to expand a tubular member, an actuator configured to pull the expansion cone through the tubular member, and a releasable locking device configured to limit displacement of the tubular member relative to the actuator during actuation, wherein the drilling device is disposed below the expansion cone and the expansion cone is disposed at a lower end of the tubular member;

locking the locking device;

after locking the locking device, drilling a wellbore to have a diameter greater than an outside diameter of the tubular member;

after the drilling, actuating the actuator to pull the expansion cone towards the locking device to expand at least a portion of the tubular member into contact with the drilled wellbore; and releasing the locking device;

after releasing the locking device, pulling upwards on the support member to pull the actuator and the expansion cone to expand any portion of the tubular member not expanded during the actuating of the actuator; and removing the drilling device through the expanded tubular member.

6. The method of claim 5, further comprising:

repeating the locking the locking device, the actuating the actuator, and the releasing the locking device to expand entire length of the tubular member.

7. The method of claim 5, wherein a motor is operably coupled to the drilling device.

* * * * *